US007571976B2

(12) United States Patent
Araki

(10) Patent No.: US 7,571,976 B2
(45) Date of Patent: Aug. 11, 2009

(54) NOZZLE CHECK PATTERN AND LIQUID DROPLET EJECTION APPARATUS

(75) Inventor: Masatoshi Araki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 265 days.

(21) Appl. No.: 11/471,860

(22) Filed: Jun. 21, 2006

(65) Prior Publication Data

US 2007/0139460 A1 Jun. 21, 2007

(30) Foreign Application Priority Data

Dec. 20, 2005 (JP) ..... 2005-366580

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 4,977,459 A * 12/1990 Ebinuma et al. ..... 358/296

FOREIGN PATENT DOCUMENTS

JP 61-261079 11/1986
JP 09-094950 4/1997
JP 2005-246649 9/2005
KR 2005-1217 1/2005

OTHER PUBLICATIONS

Translation of JP 09-094950.*
Translation of JP 2005-246649.*

* cited by examiner

*Primary Examiner*—Lamson D. Nguyen
*Assistant Examiner*—Justin Seo
(74) *Attorney, Agent, or Firm*—Fildes & Outland, P.C.

(57) ABSTRACT

A nozzle check pattern is formed by ejecting liquid droplets onto a recording medium from a nozzle row formed in a liquid droplet ejection head. The nozzle check pattern includes: a first pattern formed by assigning consecutive numbers in order to the nozzles in the nozzle row, dividing the nozzle row into plural first nozzle groups, and ejecting predetermined dots onto the recording medium in order from the nozzle with the smallest number to the nozzle with the largest number in each of the first nozzle groups; and a second pattern formed by dividing the nozzle row into second nozzle groups whose number is larger than that of the first nozzle groups and ejecting predetermined dots onto the recording medium in order from the nozzle with the smallest number to the nozzle with the largest number in each of the second nozzle groups.

16 Claims, 19 Drawing Sheets

NOZZLE CHECK PATTERN AND LIQUID DROPLET EJECTION APPARATUS

CROSS-REFERENCE TO RELATED APPLICATION

This application claims priority under 35 USC 119 from Japanese Patent Application No. 2005-366580, the disclosure of which is incorporated by reference herein.

BACKGROUND

1. Technical Field

The present invention relates to a nozzle check pattern and a liquid droplet ejection apparatus that ejects liquid droplets to form the nozzle check pattern.

2. Related Art

Inkjet recording apparatuses that eject ink from nozzles to record an image are known as liquid droplet ejection apparatuses. Among inkjet recording apparatuses, there are apparatuses provided with the function of checking the ejection status of each nozzle by recording a nozzle check pattern.

In inkjet recording apparatuses, inkjet recording heads are becoming increasingly denser and disposed with increasingly more nozzles in accordance with increases in speed and improvements in picture quality in recording apparatuses of recent years.

Further, numerous inkjet recording apparatuses of the full width array (FWA) format, which can record an image equal to the width of a page at once, have been proposed. In the case of such inkjet recording apparatus, there are also apparatuses where the number of nozzles disposed in the inkjet recording heads is several thousand.

There are various causes of defects in nozzles of the inkjet recording format, such as contamination with foreign matter and air bubbles, hardening of ink, electrical failure, and the lifespan of actuators. Yet if the rates of occurrences of defects in individual nozzles are the same, the rate of occurrences of defects in the nozzles of an inkjet recording apparatus tends to increase in accordance with increases in the number of nozzles.

At the same time, in response to increases in the rate of occurrences of defects in the nozzles, numerous methods have been proposed which identify defective nozzles and minimize, with image processing, deterioration in image quality even when ejection defects in nozzles occur. Assuming that ejection defects of several nozzles are allowed, the advantages are great, such as reducing costs resulting from a rise in the yield of inkjet recording heads and extending the lifespan of inkjet recording heads.

When such image processing is conducted, it is crucial to identify the nozzles in which ejection defects have occurred, and a method of easily and accurately identifying nozzles in which ejection defects have occurred is needed.

SUMMARY

The present invention has been made in view of the above circumstances and provides a nozzle check pattern and a liquid droplet ejection apparatus with which the presence of nozzles in which ejection defects have occurred can be easily recognized and with which those nozzles can be easily identified.

A first aspect of the invention provides a nozzle check pattern formed by relatively moving a recording medium with respect to a liquid droplet ejection head in which a nozzle row is formed and ejecting liquid droplets from the nozzle row onto the recording medium, the nozzle check pattern including: a first pattern formed by assigning consecutive numbers in order to the nozzles in the nozzle row, dividing the nozzle row into plural first nozzle groups, and ejecting predetermined dots onto the recording medium in order from the nozzle with the smallest number to the nozzle with the largest number in each of the first nozzle groups; and a second pattern formed by dividing the nozzle row into second nozzle groups whose number is larger than that of the first nozzle groups and ejecting predetermined dots onto the recording medium in order from the nozzle with the smallest number to the nozzle with the largest number in each of the second nozzle groups.

A second aspect of the invention provides a liquid droplet ejection apparatus that ejects liquid droplets to form a nozzle check pattern, the liquid droplet ejection apparatus including: a liquid droplet ejection head in which a nozzle row is formed; and a controller that causes a recording medium to move relative to the liquid droplet ejection head and ejects liquid droplets from the nozzle row onto the recording medium to form the nozzle check pattern, wherein the nozzle check pattern includes a first pattern formed by assigning consecutive numbers in order to the nozzles in the nozzle row, dividing the nozzle row into plural first nozzle groups, and ejecting predetermined dots onto the recording medium in order from the nozzle with the smallest number to the nozzle with the largest number in each of the first nozzle groups, and a second pattern formed by dividing the nozzle row into second nozzle groups whose number is larger than that of the first nozzle groups and ejecting predetermined dots onto the recording medium in order from the nozzle with the smallest number to the nozzle with the largest number in each of the second nozzle groups.

BRIEF DESCRIPTION OF THE DRAWINGS

Exemplary embodiments of the present invention will be described in detail based on the following figures, wherein.

DETAILED DESCRIPTION

Exemplary embodiments of the present invention pertaining to a nozzle check pattern and a liquid droplet ejection apparatus that ejects liquid droplets to form the nozzle check pattern will be described below on the basis of the drawings.

First Embodiment

Figure 1:
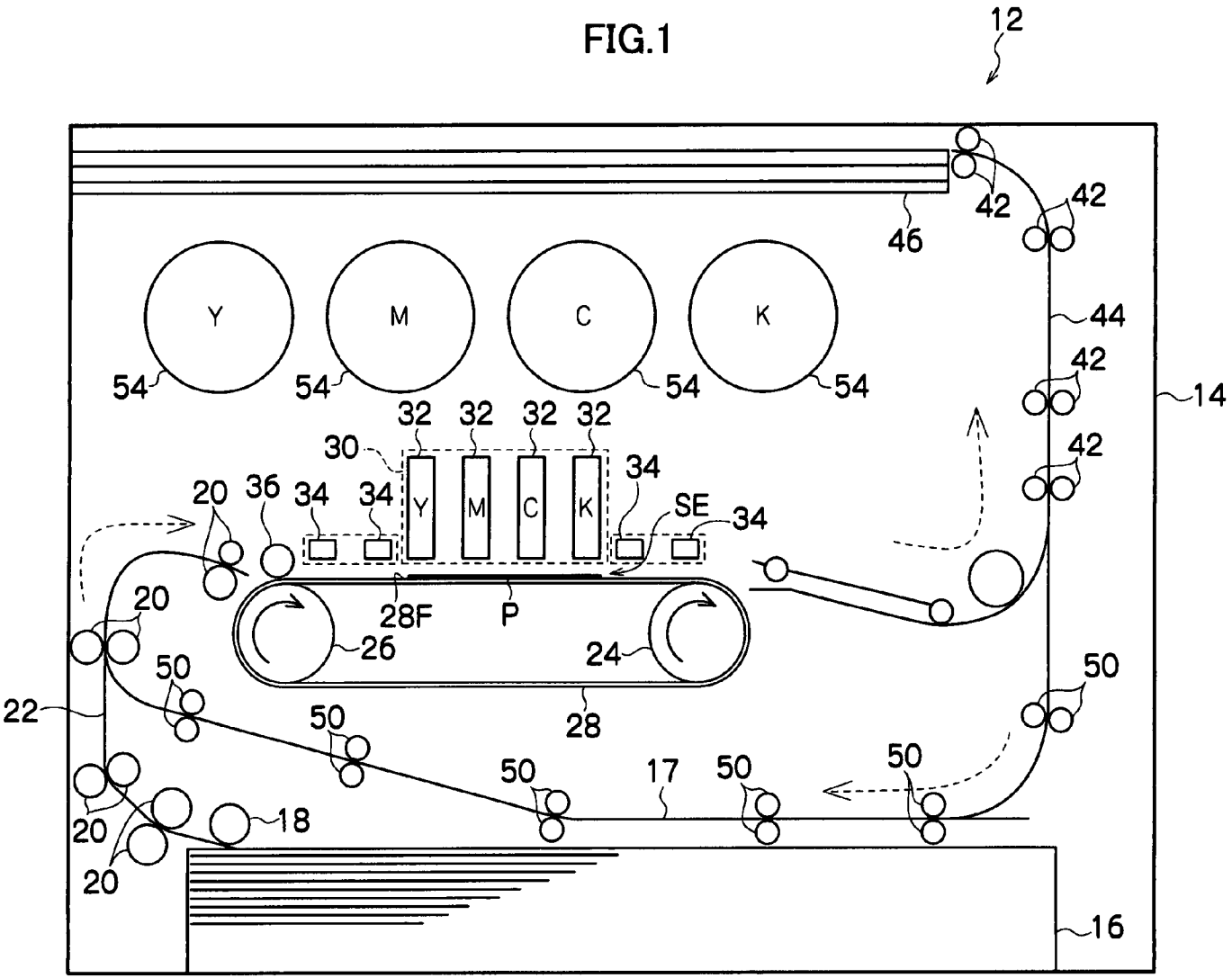
FIG. 1 is a diagram showing the overall configuration of an inkjet recording apparatus pertaining to a first embodiment of the invention.

First, the overall configuration of an inkjet recording apparatus 12 serving as the liquid droplet ejection apparatus will be described. FIG. 1 shows the inkjet recording apparatus 12 of the present exemplary embodiment.

The inkjet recording apparatus 12 includes a casing 14 in whose lower portion a paper supply tray 16 is disposed. Sheets of paper P stacked in the paper supply tray 16 are picked up one sheet at a time by a pickup roll 18. The picked-up paper P is conveyed by plural conveyance roller pairs 20 that configure a predetermined conveyance path 22.

An endless conveyor belt 28 stretched around a drive roll 24 and a driven roll 26 is disposed above the paper supply tray 16. A recording head array 30 is disposed above the conveyor belt 28, and the recording head array 30 faces a flat portion 28F of the conveyor belt 28. This region, where the recording head array 30 faces the flat portion 28F of the conveyor belt 28, serves as an ejection region SE where ink droplets are ejected from the recording head array 30. The paper P conveyed on the conveyance path 22 is retained and conveyed by the conveyor belt 28 to the ejection region SE, where ink droplets corresponding to image information are ejected from the recording head array 30 and adhere to the paper P in a state where the paper P faces the recording head array 30.

In the present exemplary embodiment, the recording head array 30 is configured as a long recording head array such that its effective recording region is equal to or greater than the width of the paper P (the length of the paper P in the direction orthogonal to the conveyance direction). The recording head array 30 includes four inkjet recording heads 32 that correspond to the four colors of yellow (Y), magenta (M), cyan (C) and black (K) and are disposed along the conveyance direction (moving direction of the paper P), whereby the recording head array 30 is capable of recording a full-color image.

A charge roll 36, to which a power supply is connected, is disposed upstream of the recording head array 30. The charge roll 36 follows the rotation of the driven roll 26 while nipping the conveyor belt 28 and the paper P between itself and the driven roll 26, and is configured to be movable between a pressing position where the charge roll 36 presses the paper P against the conveyor belt 28 and a separation position where the charge roll 36 is separated from the conveyor belt 28. Because a predetermined potential difference arises between the charge roll 36 and the grounded driven roll 26 in the pressing position, the charge roll 36 applies electrical charge to the paper P to cause the paper P to be electrostatically attracted to the conveyor belt 28.

An unillustrated registration roll is disposed upstream of the charge roll 36. The registration roll aligns the paper P before the paper P reaches the portion between the conveyor belt 28 and the charge roll 36.

A separation plate (not shown) is disposed downstream of the recording head array 30. The separation plate separates the paper P from the conveyor belt 28. The separated paper P is conveyed by plural discharge roller pairs 42, which configure a discharge path 44 downstream of the separation plate, and discharged to a paper discharge tray 46 disposed in the upper portion of the casing 14.

An inversion path 17 configured by plural inversion roller pairs 50 is disposed between the paper supply tray 16 and the conveyor belt 28. When an image has been recorded on one side of the paper P, the paper P is inverted and retained on the conveyor belt 28, so that an image can be easily recorded on the other side of the paper P.

Ink tanks 54 that respectively store inks of the aforementioned four colors are disposed between the conveyor belt 28 and the paper discharge tray 46. The inks inside the ink tanks 54 are supplied to the recording head array 30 by unillustrated ink supply pipes. Various types of known inks can be used as the inks, such as water-based inks, oil-based inks, and solvent inks.

Figure 2:
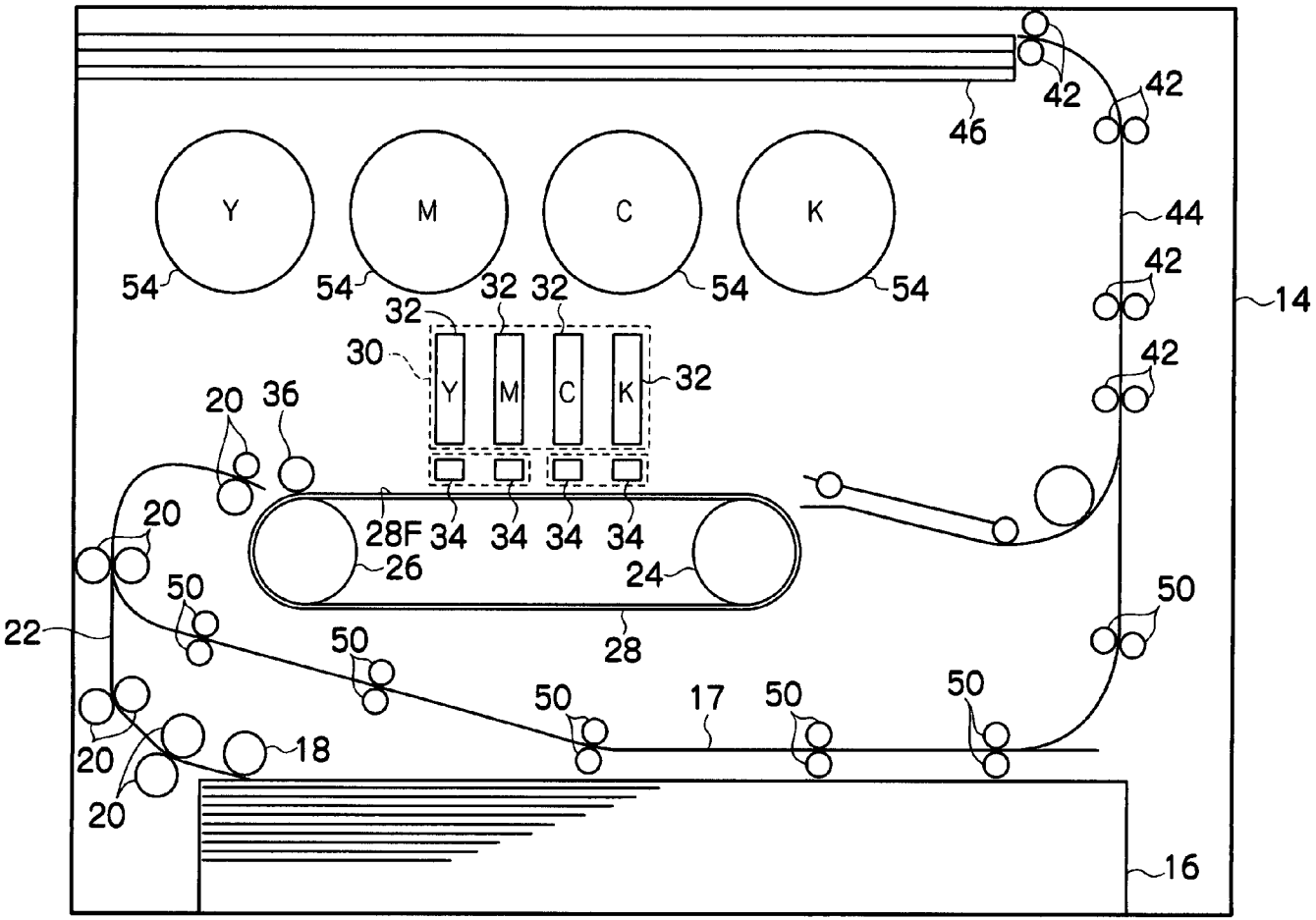
FIG. 2 is a diagram showing maintenance in the inkjet recording apparatus pertaining to the first embodiment of the invention.

A total of four maintenance units 34 corresponding to the inkjet recording heads 32 are disposed on both sides of the recording head array 30. As shown in FIG. 2, when maintenance is to be conducted with respect to the inkjet recording heads 32, the recording head array 30 moves upward and the maintenance units 34 move into a gap configured between the recording head array 30 and the conveyor belt 28. Then, the maintenance units 34 conduct predetermined maintenance (vacuuming, dummy jetting, wiping, capping, etc.) in a state where the maintenance units 34 face nozzle surfaces of the inkjet recording heads 32.

Figure 3:
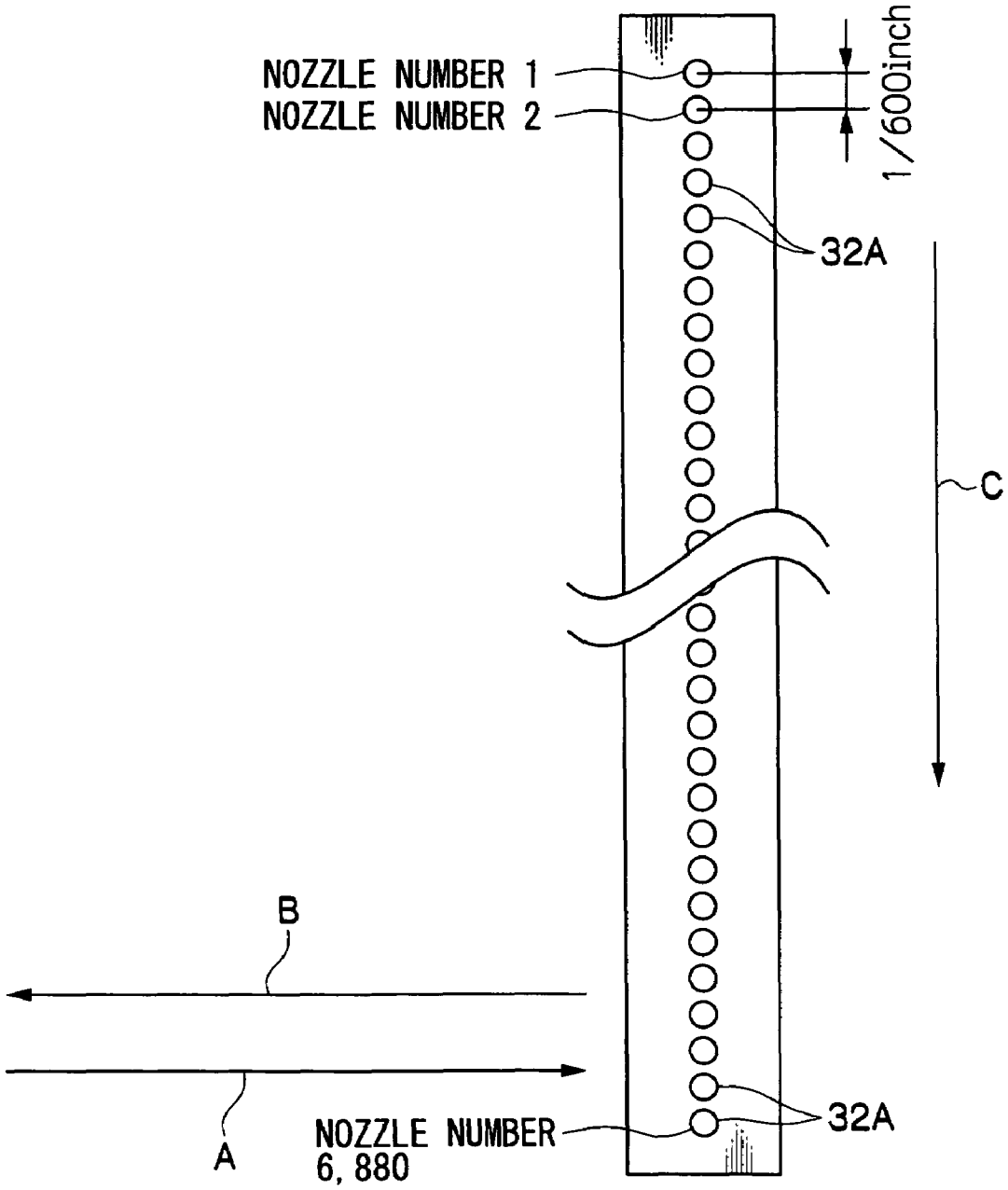
FIG. 3 is a diagram showing the arrangement of nozzles in an inkjet recording head in the inkjet recording apparatus pertaining to the first embodiment of the invention.

As shown in FIG. 3, each of the inkjet recording heads 32 includes 6,880 nozzles 32A that are arranged along a main scanning direction (direction orthogonal to the conveyance direction) C at intervals of 600 nozzles per inch (npi) (1/600 inch), for example. The nozzles 32A are configured such that they can record an image of 600 dots per inch (dpi) in the main scanning direction C as a result of the paper P being sub-scanned (conveyed) in a direction (conveyance direction) A perpendicular to the main scanning direction C.

Assigning nozzle numbers in order along the main scanning direction (direction orthogonal to the conveyance direction) C to the nozzles 32A in the nozzle row of each of the inkjet recording heads 32, the nozzle 32A disposed at one end (upper end in FIG. 3) in the main scanning direction C is nozzle number 1. Proceeding toward the other end (downward in FIG. 3) in the main scanning direction C, the nozzle numbers progress in order from nozzle number 2, nozzle number 3, etc., to nozzle number 6,879. The nozzle 32A disposed at the other end (lower end in FIG. 3) in the main scanning direction C is nozzle number 6880.

In the present exemplary embodiment, the inkjet recording apparatus 12 is configured to record an image on the paper P by sub-scanning the paper P, but the inkjet recording apparatus 12 may also be configured to record an image on the paper P by sub-scanning the inkjet recording heads 32 in the B direction in FIG. 3.

Figure 4:
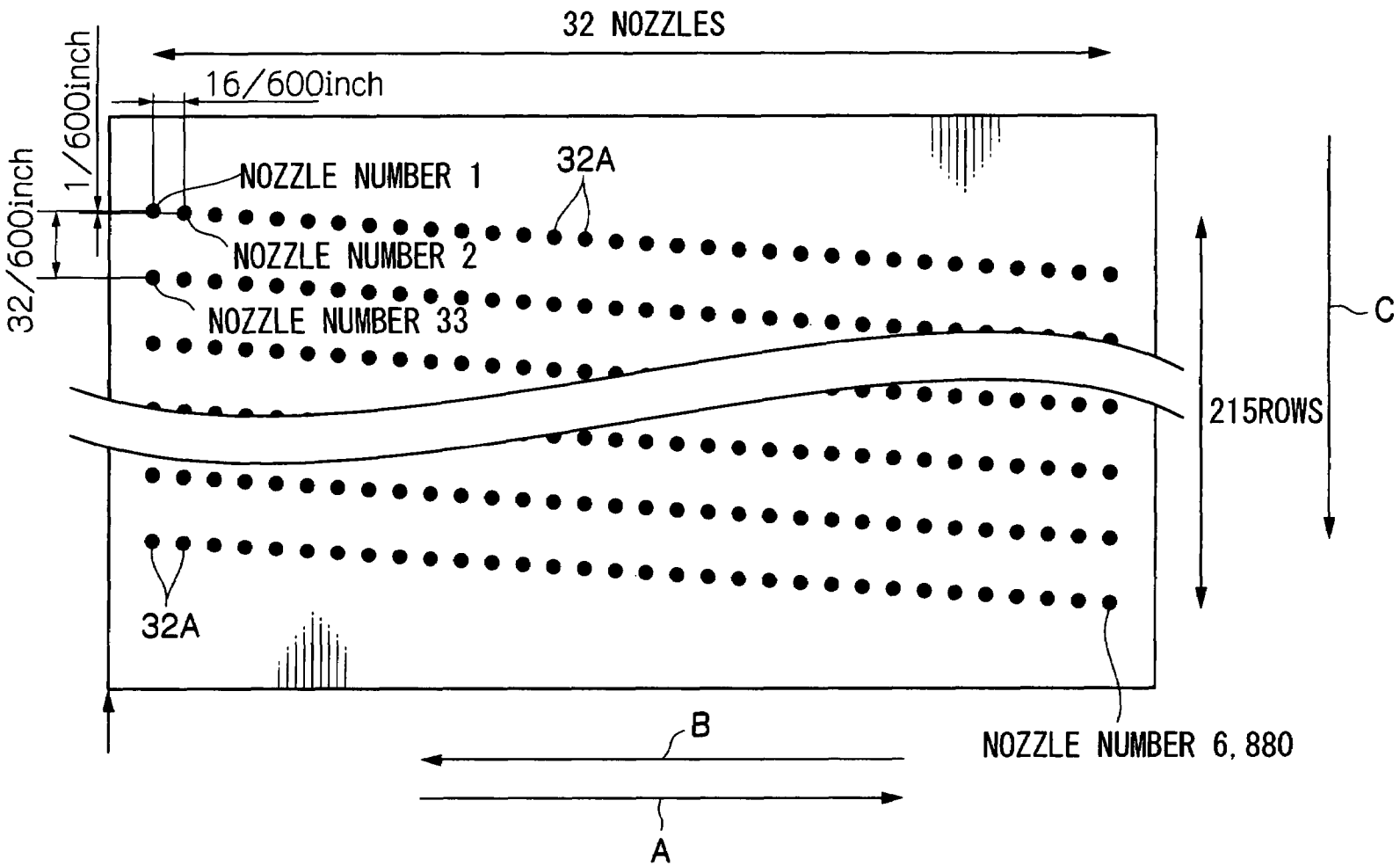
FIG. 4 is a diagram showing a modification of the arrangement of the nozzles in the inkjet recording head in the inkjet recording apparatus pertaining to the first embodiment of the invention.

Further, as shown in FIG. 4, the inkjet recording heads 32 may also be ones where the nozzles 32A are two-dimensionally arranged. In the inkjet recording head 32 shown in FIG. 4, the nozzles 32A are arranged in 215 rows, with each row containing 32 nozzles (32×215=6,880 nozzles). Each row is shifted 1/600 inch in the main scanning direction C each time the row advances from one nozzle to the next in the conveyance direction A. Thus, 600 dpi recording can be conducted in the main scanning direction C by sub-scanning (conveying) the paper P in the direction (conveyance direction) A perpendicular to the main scanning direction C.

Assigning nozzle numbers in order along the main scanning direction (direction orthogonal to the conveyance direction) C to the nozzles 32A in the nozzle rows of each of the inkjet recording heads 32, the nozzle 32A disposed at one end (upper end in FIG. 4) in the main scanning direction C is nozzle number 1. Proceeding toward the other end (downward in FIG. 4) in the main scanning direction C, the nozzle numbers progress in order from nozzle number 2, nozzle number 3, etc., to nozzle number 6,879. Because there are 32 nozzles in each row, the first nozzle 32A in the second row is nozzle number 33. The nozzle 32A disposed at the other end (lower end in FIG. 4) in the main scanning direction C is nozzle number 6880.

In this case also, the inkjet recording apparatus 12 may be configured to record an image on the paper P by sub-scanning each of the inkjet recording heads 32, rather than the paper P, in the B direction in FIG. 4.

It will be noted that when the inkjet recording heads 32 are ones where the nozzles 32A are two-dimensionally arranged, adjacent nozzles 32A are shifted 1/600 inch along the A direction (head scanning direction B) in FIG. 4, and it is necessary to eliminate this shift by adjusting the ejection timing with a later-described head drive circuit 47 (see FIG. 5) or by storing an image pattern in a later-described non-volatile memory 48 in consideration of the shift of each of the nozzles 32A and using the stored pattern.

Figure 5:
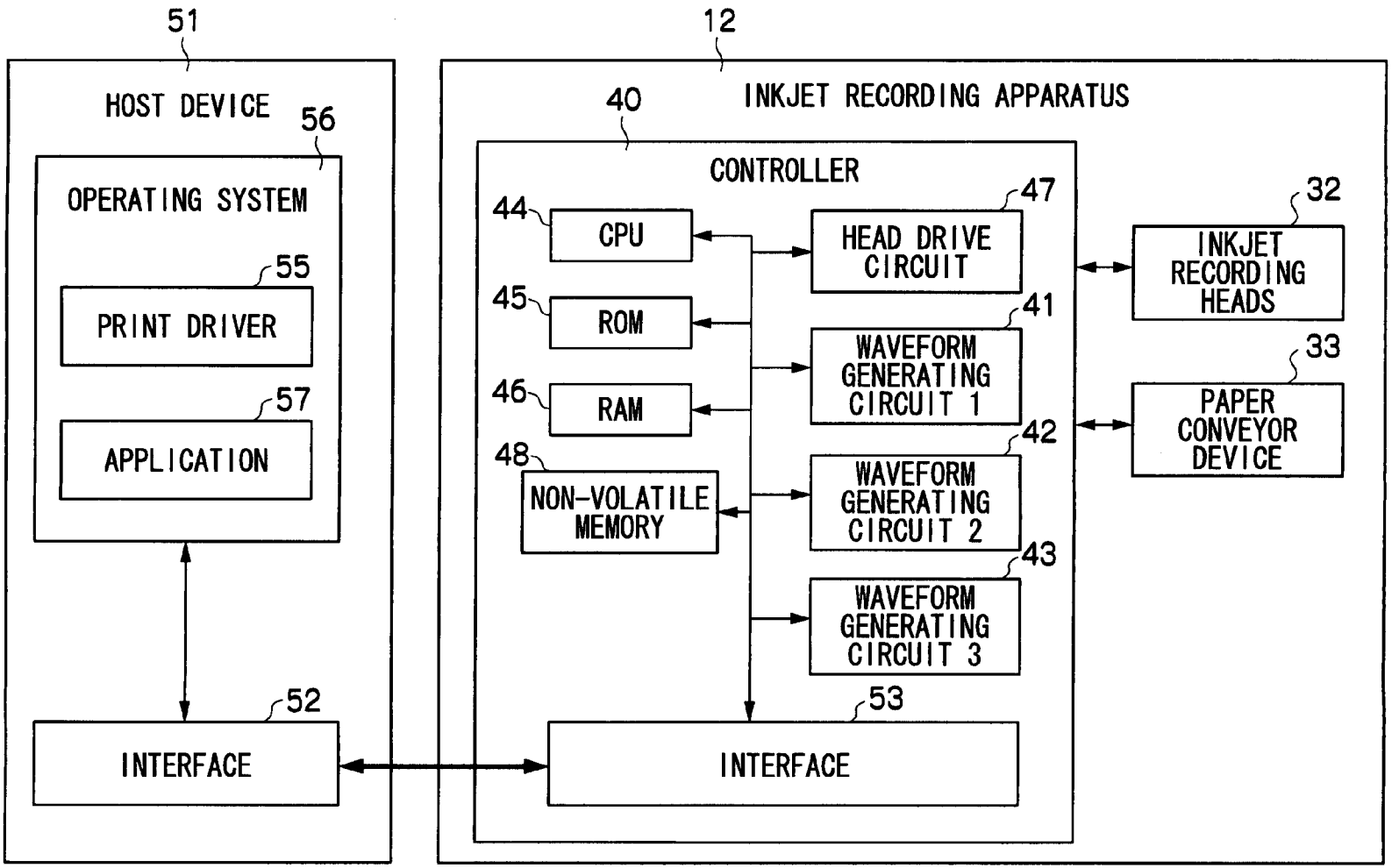
FIG. 5 is a diagram showing a control system that controls the inkjet recording apparatus pertaining to the first embodiment of the invention.

As shown in FIG. 5, the inkjet recording apparatus 12 pertaining to the present exemplary embodiment is connected to a host device 51, such as a personal computer, by a communication line such as a LAN via interfaces 52 and 53.

The host device 51 is disposed with an operating system 56, and an application program 57 and a printer driver program 55 are installed in the operating system 56.

When image recording is instructed by a user, the data of the application for which image recording has been instructed and the instructed printing conditions are sent to the printer driver 55 and pass through image conversion processing, and an image recording command and image recording data are transmitted to the inkjet recording apparatus 12 through the interfaces 52 and 53.

The inkjet recording apparatus 12 is disposed with a controller 40. The controller 40 includes a CPU 44, a ROM 45, a RAM 46, a head drive circuit 47 for driving the inkjet recording heads 32, a non-volatile memory 48, and waveform generating circuits (circuits 1 to 3) 41 to 43 that generate drive waveforms that drive actuators in the inkjet recording heads 32. All of these are connected to a hub. When an image signal such as the image recording command and the image recording data are transmitted to the inkjet recording apparatus 12, the controller 40 determines the timing at which liquid droplets are to be ejected from the inkjet recording heads 32 and the nozzles 32A to be used and applies drive signals to those nozzles 32A. The controller 40 also determines the timing and the like at which a paper conveyor device 33 configured by the pickup roll 18, the conveyor roll pairs 22, the conveyor belt 28 and the like conveys the paper P, and the controller 40 drives/controls the paper conveyor device 33.

Thus, the inkjet recording apparatus 12 is configured to record an image on the paper P with the inkjet recording heads 32.

Figure 6:
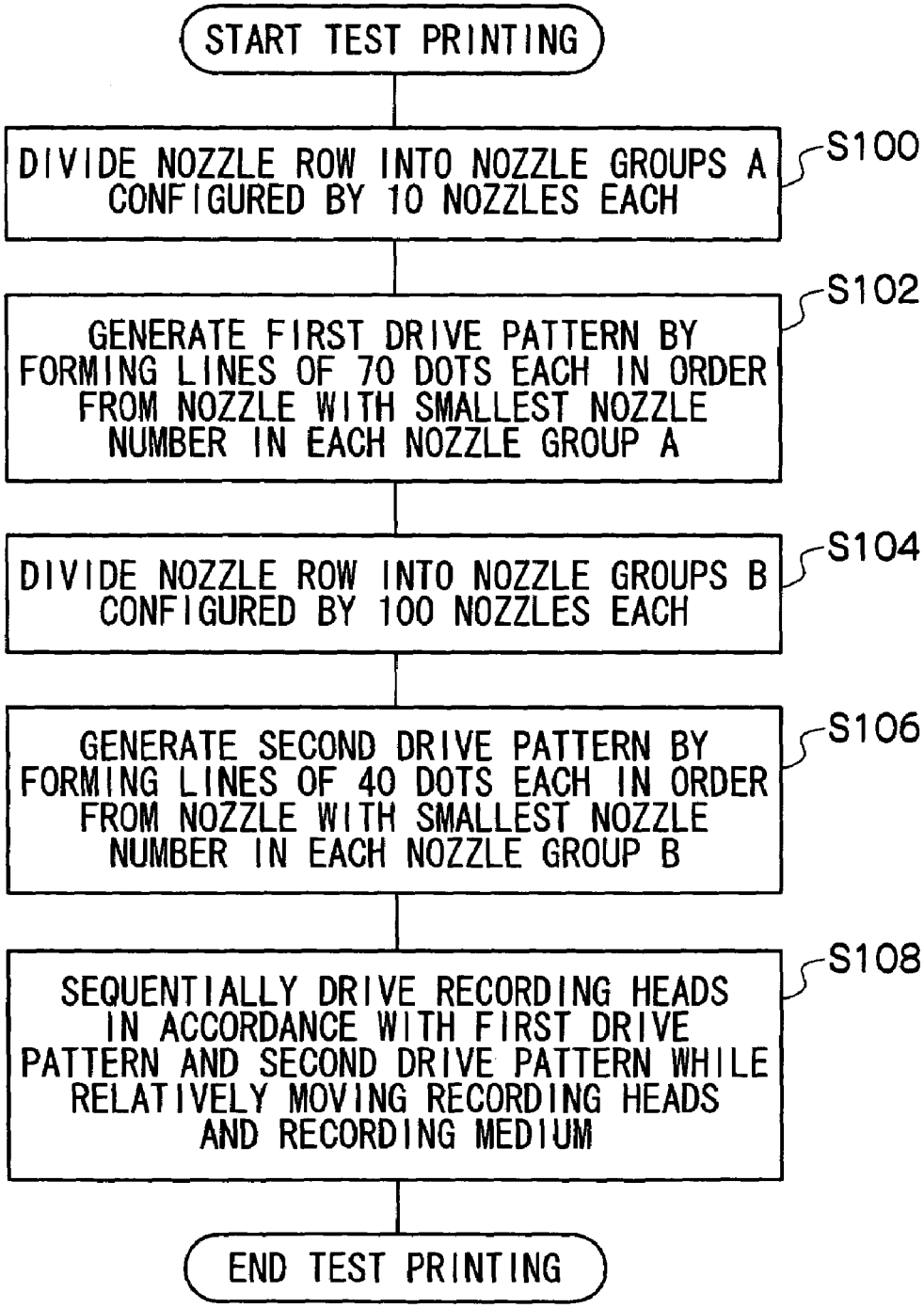
FIG. 6 is a control flow diagram showing the sequence of recording a nozzle check pattern in the inkjet recording apparatus pertaining to the first embodiment of the invention.

Here, image recording of a nozzle check pattern in the inkjet recording apparatus 12 pertaining to the present exemplary embodiment will be described on the basis of the control flow diagram shown in FIG. 6.

When a command to start test printing is received, in step 100, the nozzle row of each inkjet recording head 32 is divided into plural nozzle groups A configured by 10 nozzles each. In step 100, consecutive numbers (nozzle numbers 1 to 6,880) are assigned in order along the main scanning direction (direction orthogonal to the conveyance direction of the paper P) to the nozzles in the nozzle row, and the nozzles are divided into groups comprising 10 nozzles in the order of with the smallest nozzle number. These nozzles groups become the nozzle groups A. Because there are 6,880 nozzles in the nozzle row pertaining to the present exemplary embodiment, the nozzle row is divided into 688 nozzle groups A. For example, one nozzle group A comprises nozzle numbers 1 to 10, another nozzle group A comprises nozzle numbers 11 to 20, and another nozzle group A comprises nozzle numbers 6,871 to 6,880 (see FIGS. 3 and 4).

These nozzle groups A correspond to the second nozzle groups recited in claim 1, and later-described nozzle groups B correspond to the first nozzle groups recited in claim 1. Further, the number of nozzle groups A is greater than the number of nozzle groups B.

Next, in step 102, a line of 70 dots each is formed in each of the nozzle groups A in order from the nozzle with the smallest nozzle number to the nozzle with the largest nozzle number, whereby a first drive pattern is generated.

In step 102, first, in-group numbers of 1 to 10 are assigned in the order of the smallest nozzle number to each of the nozzles in each of the nozzle groups A. In the nozzle group A configured by nozzles with the nozzle numbers of 1 to 10, in-group numbers of 1 to 10 are assigned in the order of the nozzle numbers 1 to 10. In the nozzle group A configured by nozzles with the nozzle numbers of 11 to 20, in-group numbers of 1 to 10 are assigned in the order of the nozzle numbers 11 to 20. And in the nozzle group A configured by nozzles with the nozzle numbers of 6,871 to 6,880, in-group numbers 1 to 10 are assigned in the order of the nozzle numbers 6,871 to 6,880. In-group numbers are assigned in the same manner to the nozzles of the other nozzle groups A.

In each of the nozzle groups A, a line of 70 dots is formed in order from the nozzle with the smallest in-group number to the nozzle with the largest in-group number. Lines of 70 dots are formed simultaneously in regard to nozzles whose in-group numbers are the same. For example, a line of 70 dots is first formed by nozzles with the in-group number 1 (i.e., nozzle number 1, nozzle number 11, etc., to nozzle number 6,871). Next, a line of 70 dots is formed by nozzles with the in-group number 2 (i.e., nozzle number 2, nozzle number 12, etc., to nozzle number 6,872). Then, lines of 70 dots are sequentially formed by nozzles with nozzle numbers corresponding to the in-group numbers 3 to 9. Finally, a line of 70 dots is formed by nozzles with the in-group number 10 (i.e., nozzle number 10, nozzle number 20, etc., to nozzle number 6,880).

Thus, in each of the nozzle groups A, a line of 70 dots each is formed in steps in order from the nozzle with the smallest nozzle number to the nozzle with the largest nozzle number. Thus, 688 diagonal lines 60A formed in steps (the number of steps is 10) are formed, and these become the first drive pattern 60 (see FIGS. 7 and 8).

Figure 7:
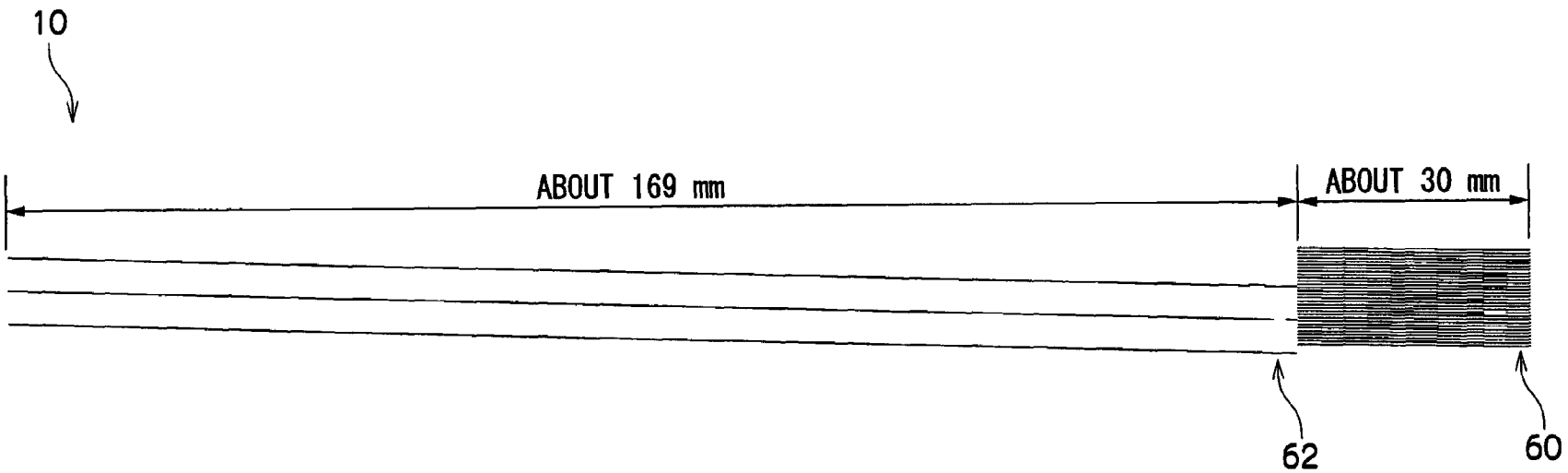
FIG. 7 is a diagram showing the nozzle check pattern pertaining to the first embodiment of the invention.
Figure 8:
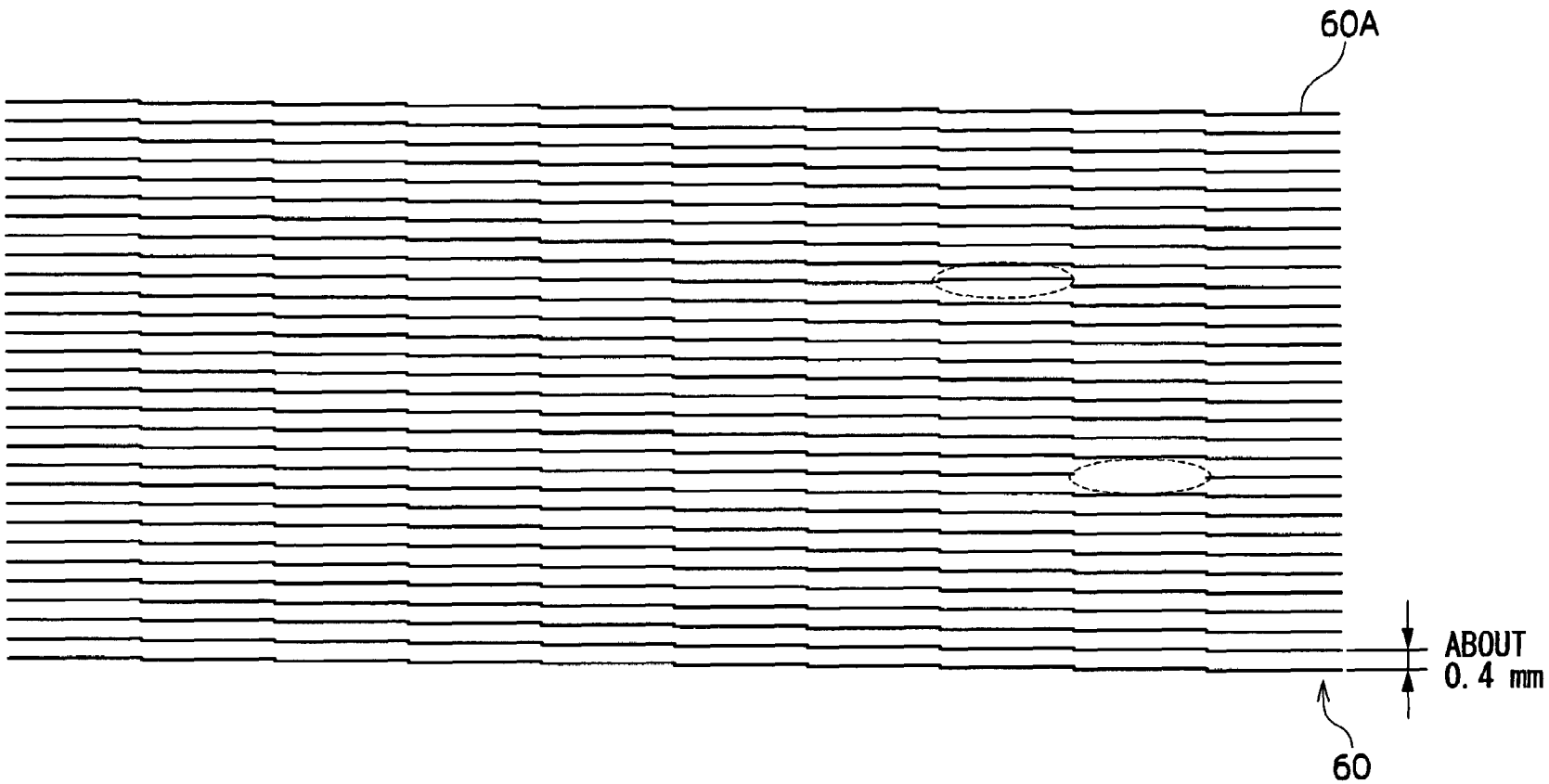
FIG. 8 is a diagram showing a first drive pattern pertaining to the first embodiment of the invention.

This first drive pattern 60 corresponds to the second pattern recited in claim 1, and a later-described second drive pattern 62 corresponds to the first pattern recited in claim 1. FIGS. 7 and 8 show the first drive pattern 60 formed by some of the nozzles (nozzle numbers 1 to 300) in the nozzle row.

Next, in step 104, the nozzle row is divided into plural nozzle groups B configured by 100 nozzles each. In step 104, the nozzles are divided into groups comprising 100 nozzles each in the order of the smallest nozzle number on the basis of the consecutive numbers assigned to the nozzle row in step 100. These nozzle groups become the nozzle groups B. Because there are 6,880 nozzles in the nozzle row pertaining to the present exemplary embodiment, the nozzle row is divided into 69 nozzle groups B. For example, one nozzle group B comprises nozzle numbers 1 to 100, another nozzle group B comprises nozzle numbers 101 to 200, another nozzle group B comprises nozzle numbers 6,701 to 6,800, and another nozzle group B comprises nozzle numbers 6,801 to 6,880. The nozzle group B comprising nozzle numbers 6,801 to 6,880 is configured by 80 nozzles that are an odd lot.

Next, in step 106, a line of 40 dots each is formed in each of the nozzle groups B in order from the nozzle with the smallest nozzle number to the nozzle with the largest nozzle number, whereby a second drive pattern 62 is generated.

In step 106, first, in-group numbers of 1 to 100 are assigned in the order of the smallest nozzle number to each of the nozzles in each of the nozzle groups B. In the nozzle group B configured by nozzles with the nozzle numbers of 1 to 100, in-group numbers of 1 to 100 are assigned in the order of the nozzle numbers 1 to 100. In the nozzle group B configured by nozzles with the nozzle numbers of 101 to 200, in-group numbers of 1 to 100 are assigned in the order of the nozzle numbers 101 to 200. And in the nozzle group B configured by nozzles with the nozzle numbers of 6,801 to 6,880, in-group numbers 1 to 80 are assigned in the order of the nozzle numbers 6,801 to 6,880. In-group numbers are assigned in the same manner to the nozzles of the other nozzle groups B.

In each of the nozzle groups B, a line of 40 dots is formed in order from the nozzle with the smallest in-group number to the nozzle with the largest in-group number. Lines of 40 dots each are formed simultaneously in regard to nozzles whose in-group numbers are the same. For example, a line of 40 dots is first formed by nozzles with the in-group number 1 (i.e., nozzle number 1, nozzle number 101, etc., to nozzle number 6,801). Next, a line of 40 dots is formed by nozzles with the in-group number 2 (i.e., nozzle number 2, nozzle number 102, etc., to nozzle number 6,802). Then, lines of 40 dots are sequentially formed by nozzles with nozzle numbers corresponding to the in-group numbers 3 to 9. Finally, a line of 40 dots is formed by nozzles with the in-group number 100 (i.e., nozzle number 100, nozzle number 200, etc., to nozzle number 6,800).

Figure 9A:
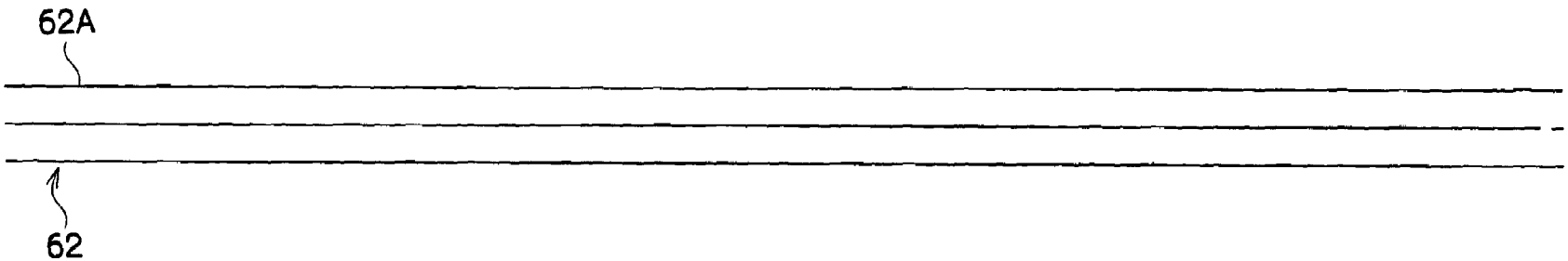
FIG. 9A is a diagram showing a second drive pattern pertaining to the first embodiment of the invention.

Thus, in each of the nozzle groups B, a line of 40 dots each is formed in steps in order from the nozzle with the smallest nozzle number to the nozzle with the largest nozzle number. Thus, 69 diagonal lines 62A formed in steps (the number of steps is 100, with the final row having 80 steps) are formed, and these become the second drive pattern 62 (see FIGS. 7 and 9A). FIGS. 7 and 9A show the second drive pattern 62 formed by some of the nozzles (nozzle numbers 1 to 300) in the nozzle row.

Next, in step 108, the inkjet recording heads 32 are sequentially driven in accordance with the first drive pattern 60 and the second drive pattern 62 while the inkjet recording heads (recording heads) 32 and the paper (recording medium) are relatively moved. The first drive pattern 60 and the second drive pattern 62 are generated by the controller 40. On the basis of the generated first drive pattern 60 and second drive pattern 62, the controller 40 controls the driving of the inkjet recording heads 32 and, as shown in FIG. 7, records a nozzle check pattern 10 configured by the first drive pattern 60 and the second drive pattern 62 on the same paper P by the same recording scanning, and the test printing ends.

In the present exemplary embodiment, the nozzles are arranged at intervals of 600 npi in the main scanning direction. In this configuration, as shown in FIG. 7, the width of the first drive pattern 60 in the sub-scanning direction (conveyance direction) is about 30 mm. Further, in the first drive pattern 60, as shown in FIG. 8, the spaces between the step-like diagonal lines 60A are about 0.4 mm, which is narrow.

For this reason, the first drive pattern 60 has a predetermined density, and places where nozzle clogging and defects in the ejection direction have occurred can be discriminated as white spots. Thus, the presence of defective nozzles can be recognized at a glance.

Figure 9B:
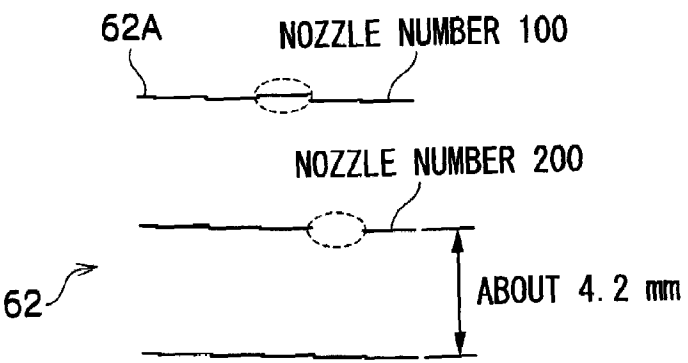
FIG. 9B is an enlarged view showing part of the second drive pattern pertaining to the first embodiment of the invention.

As shown in FIG. 7, the width of the second drive pattern 62 along the sub-scanning direction (conveyance direction) is about 169 mm. Further, in the second drive pattern 62, as shown in FIG. 9B, the spaces between the step-like diagonal lines 62A are about 4.2 mm, which is wide.

In the first drive pattern 60, it is difficult to identify the positions (nozzle numbers) of defective nozzles because the spaces between the lines are 0.4 mm, which is narrow, but in the second drive pattern 62, it becomes easy to visually identify the positions (nozzle numbers) of defective nozzles because the spaces between the lines are 4.2 mm, which is wide. That is, visual confirmation becomes easy because nozzle numbers where nozzle clogging and ejection direction defects have occurred are indicated by the first drive pattern 60 and the nozzle numbers can be identified with the second drive pattern 62.

The first drive pattern 60 and the second drive pattern 62 shown in FIGS. 7, 8, 9A and 9B represent an example where the nozzle with nozzle number 98 has an ejection direction defect and the nozzle with nozzle number 199 is clogged. Because the first diagonal line 62A at the top of the second drive pattern 62 corresponds to nozzle numbers 1 to 100 and the first line (step) at the right end corresponds to nozzle number 100, it is understood by visually counting the lines that the nozzle with the ejection direction defect is nozzle 98. Further, because the second diagonal line 62A from the top of the second drive pattern 62 corresponds to nozzle numbers 101 to 200 and the second line (step) at the right end corresponds to nozzle number 200, it is understood by visually counting the lines that the clogged nozzle is nozzle number 199 (refer to the portions surrounded by dotted lines in FIGS. 8 and 9B).

As described above, the nozzle check pattern is divided into the first drive pattern 60 and the second drive pattern 62, and the numbers of their respective groups are different. Thus, a pattern (first drive pattern 60) whose intervals are narrow in the main scanning direction and with which defective nozzles can be grasped at a glance and a pattern (second drive pattern 62) whose intervals are wide in the main scanning direction and with which it is easy to grasp the positions of defective nozzles can be recorded.

Further, by repeating the work of recognizing the number of defective nozzles with the pattern (first drive pattern 60)

with which the number of defective nozzles is easy to grasp, moving one's line of sight in the sub-scanning direction (direction orthogonal to the main scanning direction) with respect to defective nozzles that have been recognized, and identifying nozzle numbers with the pattern (second drive pattern 62) with which defective nozzle numbers can be identified, it becomes possible to identify defective nozzle numbers while reducing the potential for defective nozzles to be overlooked.

Particularly by assigning marks (numbers) or appropriately inserting partition symbols, it also becomes possible to make it easy to count the nozzle numbers. By disposing numbers by which nozzle numbers can be identified in the vicinity of each nozzle-formed line, it is also possible to grasp the nozzle numbers without counting.

Further, the first drive pattern 60 may be formed on both sides of the second drive pattern 62 such that it sandwiches the second drive pattern 62. Thus, whether or not there are defective nozzles can be reliably recognized, and the positions of the nozzle numbers of defective nozzles also become easier to grasp.

Second Embodiment

Next, a second embodiment of the invention will be described. The same reference numerals will be given to portions that are the same as those in the first embodiment, and description thereof will be omitted. Further, because the overall configuration of the inkjet recording apparatus in the present exemplary embodiment is the same as that in the first embodiment, description thereof will be omitted.

Figure 10:
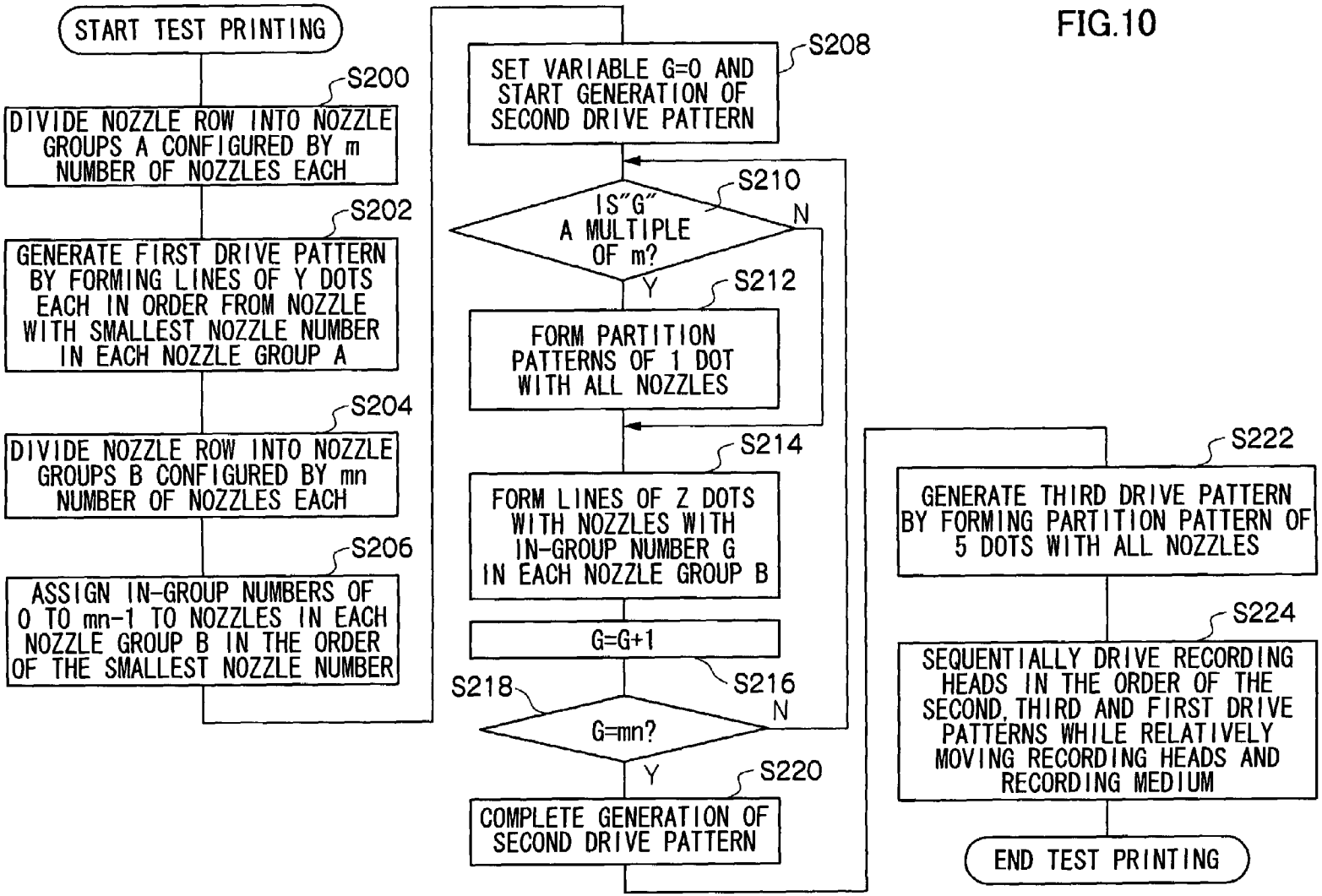
FIG. 10 is a control flow diagram showing the sequence of recording a nozzle check pattern in an inkjet recording apparatus pertaining to a second embodiment of the invention.

First, image recording of the nozzle check pattern in the inkjet recording apparatus pertaining to the present exemplary embodiment will be described on the basis of the control flow diagram shown in FIG. 10.

In the first embodiment, recording is conducted by inkjet recording heads where 6,880 nozzles are arranged, but in the second embodiment, recording is conducted at 300×300 dpi by 300 npi inkjet recording heads where 400 nozzles are arranged.

When a command to start test printing is received, in step 200, the nozzle row is divided into plural nozzle groups A configured by m number of nozzles each (where m is an optional natural number). In the present exemplary embodiment, m=8.

In step 200, consecutive numbers (nozzle numbers 0 to 399) are assigned in order along the main scanning direction (direction orthogonal to the conveyance direction of the paper P) to the nozzles in the nozzle row, and the nozzles are divided into groups comprising m number of nozzles each in the order of the smallest nozzle number. These nozzles groups become the nozzle groups A. Because there are 400 nozzles in the nozzle row pertaining to the present exemplary embodiment, the nozzle row is divided into 50 nozzle groups A. For example, one nozzle group A comprises nozzle numbers 0 to 7, another nozzle group A comprises nozzle numbers 8 to 15, and another nozzle group A comprises nozzle numbers 392 to 399.

These nozzle groups A correspond to the second nozzle groups recited in claim 1, and later-described nozzle groups B correspond to the first nozzle groups recited in claim 1. Further, the number of nozzle groups A is greater than the number of nozzle groups B.

Next, in step 202, a line of Y dots each is formed in each of the nozzle groups A in order from the nozzle with the smallest nozzle number to the nozzle with the largest nozzle number, whereby a first drive pattern 70 is generated. In the present exemplary embodiment, Y=40. In 300 dpi recording, the lines of Y dots are 3.4 mm.

In step 202, first, in-group numbers of 0 to 7 are assigned in the order of the smallest nozzle number to each of the nozzles in each of the nozzle groups A. In the nozzle group A configured by nozzles with the nozzle numbers of 0 to 7, in-group numbers of 0 to 7 are assigned in the order of the nozzle numbers 0 to 7. In the nozzle group A configured by nozzles with the nozzle numbers of 8 to 15, in-group numbers of 0 to 7 are assigned in the order of the nozzle numbers 8 to 15. And in the nozzle group A configured by nozzles with the nozzle numbers of 392 to 399, in-group numbers 0 to 7 are assigned in the order of the nozzle numbers 392 to 399. In-group numbers are assigned in the same manner to the nozzles of the other nozzle groups A.

In each of the nozzle groups A, a line of 40 dots is formed in order from the nozzle with the smallest in-group number to the nozzle with the largest in-group number. Lines of 40 dots are formed simultaneously in regard to nozzles whose in-group numbers are the same. For example, a line of 40 dots is first formed by nozzles with the in-group number 0 (i.e., nozzle number 0, nozzle number 8, etc., to nozzle number 392). Next, a line of 40 dots is formed by nozzles with the in-group number 1 (i.e., nozzle number 1, nozzle number 9, etc., to nozzle number 393). Then, lines of 40 dots are sequentially formed by nozzles with nozzle numbers corresponding to the in-group numbers 2 to 6. Finally, a line of 40 dots is formed by nozzles with the in-group number 7 (i.e., nozzle number 7, nozzle number 15, etc., to nozzle number 399).

Thus, in each of the nozzle groups A, a line of 40 dots each is formed in steps in order from the nozzle with the smallest nozzle number to the nozzle with the largest nozzle number. Thus, 50 diagonal lines 70A formed in steps (the number of steps is 8) are formed, and these become the first drive pattern 70 (see FIGS. 11 and 12).

This first drive pattern 70 corresponds to the second pattern recited in claim 1, and a later-described second drive pattern 72 corresponds to the first pattern recited in claim 1.

Next, in step 204, the nozzle row is divided into plural nozzle groups B configured by m×n nozzles each (where n is an optional natural number). m×n becomes a reference of the distance between later-described diagonal lines 72A in the second drive pattern 72. Because it is necessary for the lines be visually countable, a certain distance becomes necessary. In the present exemplary embodiment, n=10. Thus, m×n=80, and an interline distance of about 6.8 mm is ensured because the inkjet recording heads are 300 npi. Further, it is preferable for the natural numbers m and n to be numbers that are close to m=n and small in a range allowed by the interline distance resulting from m×n, because they become the maximum of the number that must be counted in order to identify the nozzle numbers of defective nozzles. Here, the nozzle groups B are configured by 80 nozzles each.

In step 204, the nozzle row is divided into groups comprising 80 nozzles each in the order of the smallest nozzle number on the basis of the consecutive numbers assigned to the nozzle row in step 200. These nozzle groups become the nozzle groups B. Because there are 400 nozzles in the nozzle row pertaining to the present exemplary embodiment, the nozzle row is divided into 5 nozzle groups B. For example, one nozzle group B comprises nozzle numbers 0 to 79, another nozzle group B comprises nozzle numbers 80 to 159, and another nozzle group B comprises nozzle numbers 320 to 399.

Next, in step 206, in-group numbers of 0 to 79 (m×n−1) are assigned in the order of the smallest nozzle number to each of the nozzles in each of the nozzle groups B. In the nozzle group B configured by nozzles with the nozzle numbers of 0 to 79, in-group numbers of 0 to 79 are assigned in the order of the nozzle numbers 0 to 79. In the nozzle group B configured by nozzles with the nozzle numbers of 80 to 159, in-group numbers of 0 to 79 are assigned in the order of the nozzle numbers 80 to 159. And in the nozzle group B configured by nozzles with the nozzle numbers of 320 to 399, in-group numbers 0 to 79 are assigned in the order of the nozzle numbers 320 to 399. In-group numbers are assigned in the same manner to the nozzles of the other nozzle groups B.

Next, in step 208, a variable G=0 is set and the generation of the second drive pattern is started.

Next, in step 210, it is determined whether the variable G is a multiple of m. When the variable G is not a multiple of m, then the control flow moves to step 214. When the variable G is a multiple of m, then partition patterns 74 (corresponding to the first partition lines recited in claim 6) of 1 dot are formed by all of the 400 nozzles in step 212.

Next, in step 214, lines of Z dots are formed by the nozzles with the in-group number G in each of the nozzle groups B. The lines of Z dots correspond to the length of each step of the diagonal lines 72A of the second drive pattern 72. It is not necessary to count the steps here; it suffices as long as it can be visually checked whether spaces are present. Thus, it is not necessary for the steps to have a length of several millimeters; it suffices for the length to be 0.3 mm or greater. In the present exemplary embodiment, Z is equal to 5 dots (Y÷m=40÷8=5 dots) in order to make the partition intervals in the second drive pattern 72 and the lengths of the steps in the first drive pattern 70 equal. Z=5 dots becomes about 0.42 mm in 300 dpi. Lines of 5 dots are formed simultaneously in regard to nozzles whose in-group numbers are the same.

Next, in step 216, 1 is added to the variable G, and in step 218, it is determined whether the variable G equals m×n. When the variable G does not equal m×n, then the control flow returns to step 210 and steps 210 to 216 are repeated. When it is determined that the variable G equals m×n, then the generation of the second drive pattern 72 is completed in step 220.

Thus, in each of the nozzle groups B, a line of 5 dots each is formed in steps in order from the nozzle with the smallest nozzle number to the nozzle with the largest nozzle number. Thus, 5 diagonal lines 72A formed in steps (the number of steps is 80) are formed, and these become the second drive pattern 72 (see FIGS. 11 and 12).

Next, in step 222, a partition pattern of 5 dots is formed by all of the 400 nozzles, whereby a third drive pattern (corresponding to the pattern partition line recited in claim 5) 78 is formed.

Next, in step 224, the inkjet recording heads are sequentially driven in the order of the second drive pattern 72, the third drive pattern 78 and the first drive pattern 70 while the inkjet recording heads (recording heads) and the paper (recording medium) are relatively moved. The second drive pattern 72, the third drive pattern 78 and the first drive pattern 70 are generated by the controller 40. On the basis of the generated second drive pattern 72, third drive pattern 78 and first drive pattern 70, the controller 40 controls the driving of the inkjet recording heads and, as shown in FIG. 11, records a nozzle check pattern 11 configured by the second drive pattern 72, the third drive pattern 78 and the first drive pattern 70 on the same paper P by the same recording scanning, and the test printing ends.

Figure 11:
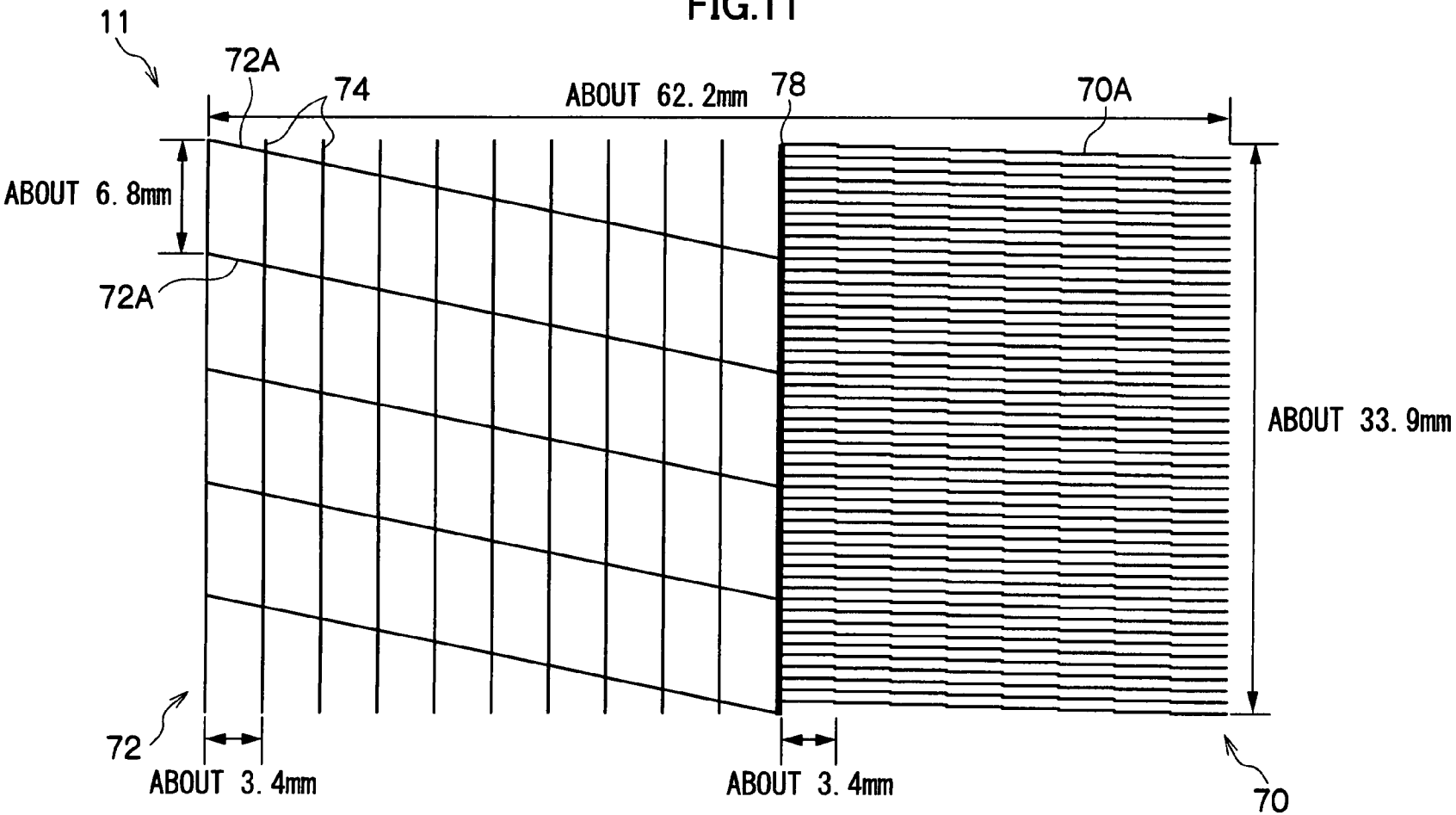
FIG. 11 is a diagram showing the nozzle check pattern pertaining to the second embodiment of the invention.

In the present exemplary embodiment, as shown in FIG. 11, the combined width of the second drive pattern 72, the third drive pattern 78 and the first drive pattern 70 in the sub-scanning direction (conveyance direction) is about 62.2 mm. Their length in the main scanning direction (direction orthogonal to the conveyance direction) is about 33.9 mm. The length of the line in each step of the diagonal lines 70A in the first drive pattern 70 and the intervals between the partition patterns 74 in the second drive pattern 72 are about 3.4 mm. The intervals between the diagonal lines 72A in the second drive pattern 72 are 6.8 mm.

Figure 12:
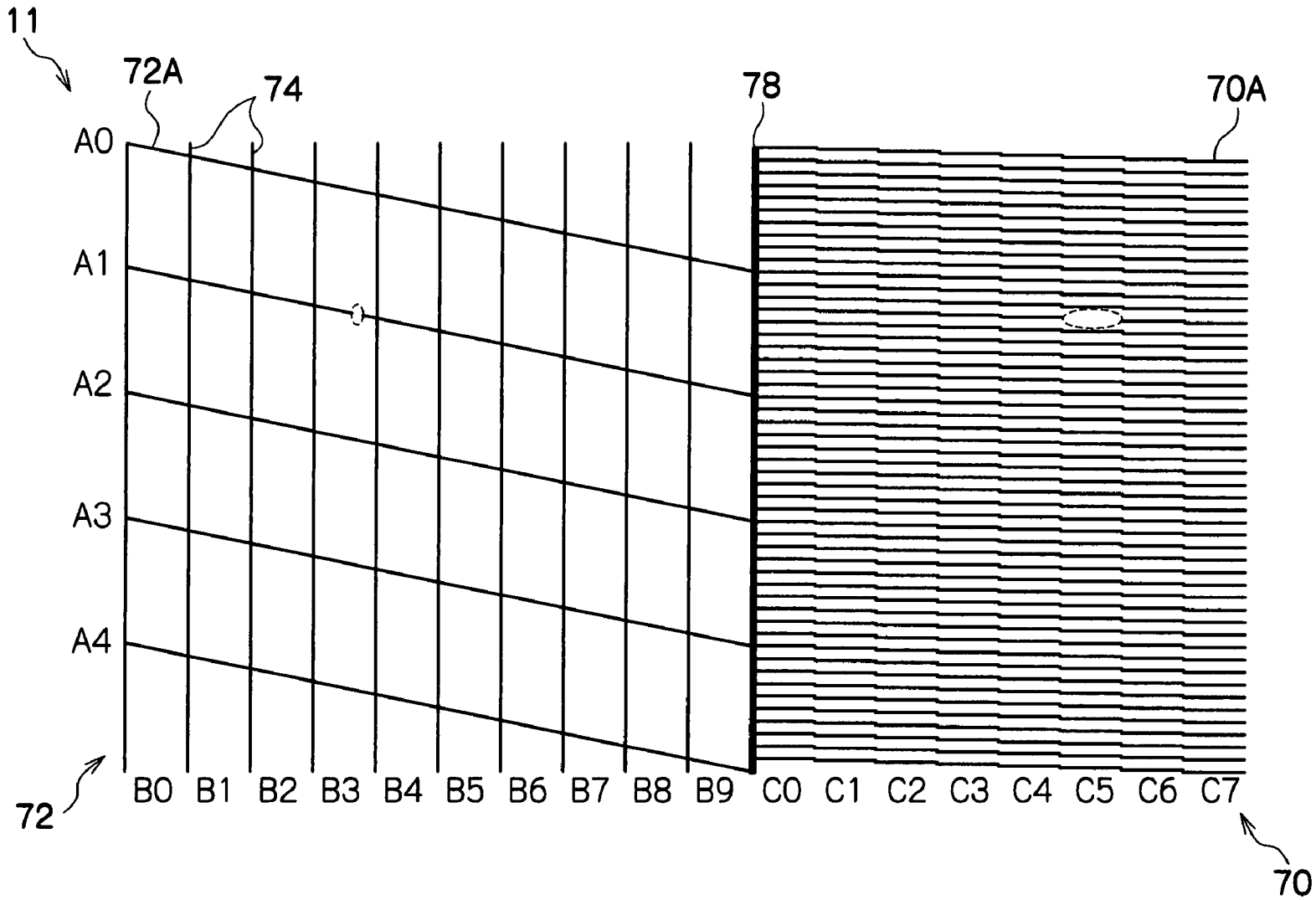
FIG. 12 is a diagram showing a case where a defective nozzle is present in the nozzle check pattern pertaining to the second embodiment of the invention.

Next, the method of identifying the nozzle numbers of defective nozzles when defective nozzles are present in the inkjet recording head pertaining to the present exemplary embodiment will be described. FIG. 12 shows an example where nozzle number 109 has become unable to eject liquid droplets. The marks A0 to C7 in FIG. 12 are for descriptive purposes, and in the present exemplary embodiment it is not necessary to record them in the nozzle check pattern.

First, whether there are line defects is checked using the first drive pattern 70. The first drive pattern 70 has a predetermined density because the spaces between the step-like diagonal lines 70A in the first drive pattern 70 are narrow, and places where nozzle clogging and defects in the ejection direction have occurred can be discriminated as white spots. Thus, the presence of defective nozzles can be recognized at a glance. It will be understood that, in FIG. 12, there is a defect in one of the lines in column C5. That is, it will be understood that there is a defect in the fifth position counted from 0 in the first drive pattern 70.

Next, one moves his/her line of sight in the sub-scanning direction from the defective position in the first drive pattern 70 and confirms the defective position in the second drive pattern 72. It will be understood that there is a defect in the position of B3 in the second drive pattern 72. The position that is necessary here is not in which step the defect has occurred but in which partition counted from 0 is the position where the defect has occurred. B3 is counted as the third from the left when counted from 0.

Next, the row in which the defective nozzle is present is counted with the second drive pattern 72. It will be understood that in FIG. 12, it is the first row from above when counted from 0. Using the above information, the nozzle number is calculated.

The calculation is done as follows: nozzle number=(row number in second drive pattern×m×n)+(column number in second drive pattern×m)+(column number in first drive pattern). In the example of FIG. 12, the nozzle number is 109 (=1×8×10+3×8+5), and it can be determined that the defect has occurred in nozzle number 109.

Next, the nozzle check pattern pertaining to the present exemplary embodiment will be compared with a conventional nozzle check pattern.

Figure 13:
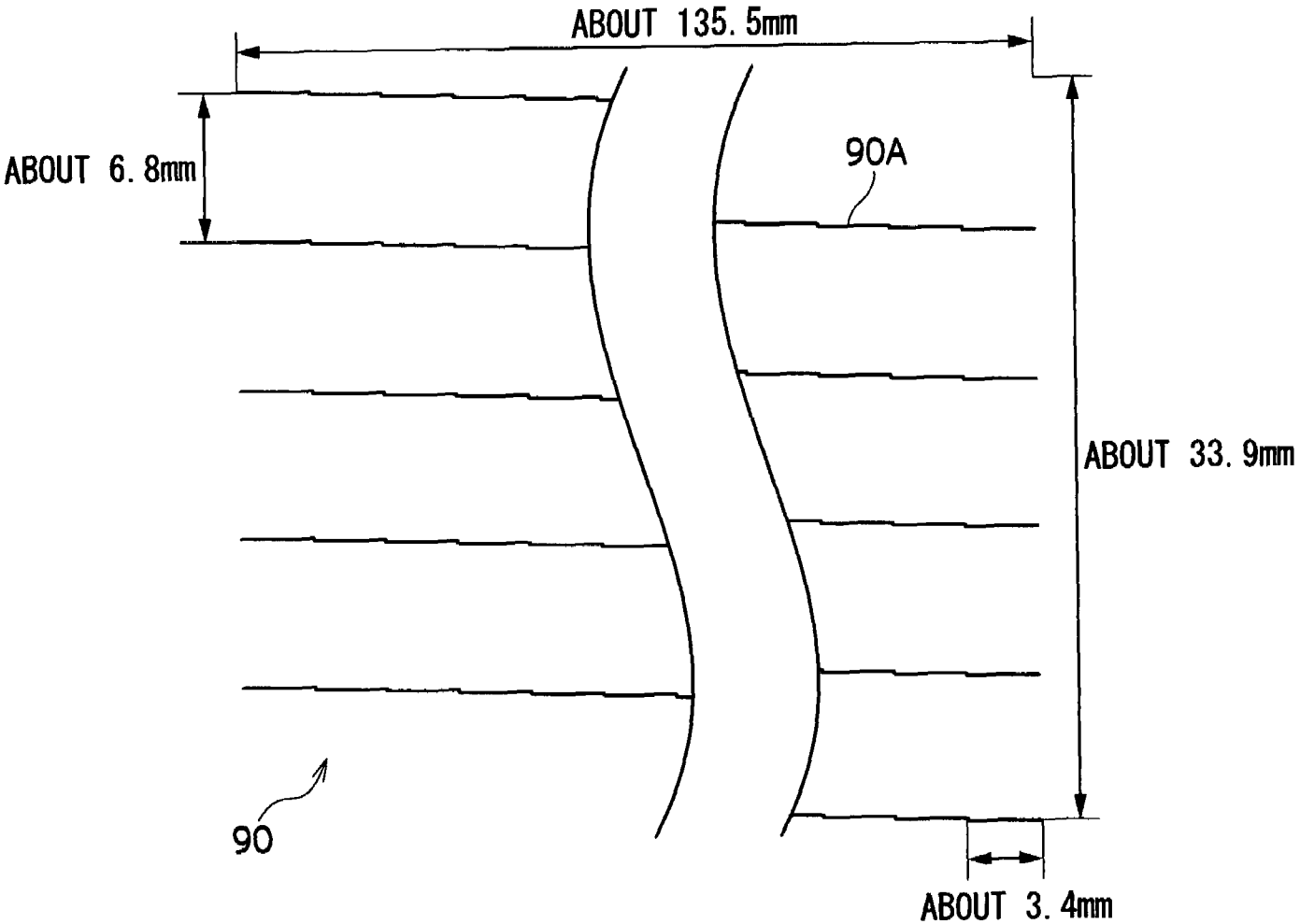
FIG.13 RELATED ART
FIG. 13 is a diagram showing a conventional nozzle check pattern.

FIG. 13 shows a conventional nozzle check pattern 90. The conventional nozzle check pattern 90 is an example where 400 nozzles are divided into 5 nozzle groups configured by 80 nozzles each, and where in each nozzle group, a line of 40 dots each is formed in order from the nozzle with the smallest nozzle number to the nozzle with the largest nozzle number. In this conventional nozzle check pattern 90, the spaces between diagonal lines 90A are 6.8 mm and the length of each line is 3.4 mm, which are the same conditions as in the present exemplary embodiment.

As shown in FIG. 13, the width of the nozzle check pattern 90 is 135.5 mm, which is more than twice the width 62.2 mm of the nozzle check pattern 11 of the present exemplary embodiment shown in FIG. 12.

As described above, according to the present exemplary embodiment, the nozzle check pattern is divided into the first drive pattern 70 and the second drive pattern 72, and the numbers of their respective groups are different. Thus, a pattern (first drive pattern 70) whose intervals are narrow in the main scanning direction and with which defective nozzles can be grasped at a glance and a pattern (second drive pattern 72) whose intervals are wide in the main scanning direction and with which it is easy to grasp the positions of defective nozzles can be recorded.

Thus, visual confirmation becomes easy because nozzle numbers where nozzle clogging and ejection direction defects have occurred are indicated by the first drive pattern 70 and the nozzle numbers can be identified with the second drive pattern 72.

Further, by repeating the work of recognizing the number of defective nozzles with the pattern (first drive pattern 70) with which the number of defective nozzles is easy to grasp, moving one's line of sight in the sub-scanning direction (direction orthogonal to the main scanning direction) with respect to defective nozzles that have been recognized, and identifying nozzle numbers with the pattern (second drive pattern 72) with which defective nozzle numbers can be identified, it becomes possible to identify defective nozzle numbers while reducing the potential for defective nozzles to be overlooked.

Further, in the present exemplary embodiment, the partition patterns 74 are formed in the second drive pattern 72 each time nozzles corresponding to the number of nozzles in each of the nozzle groups A that form the first drive pattern 70 (in the present exemplary embodiment, 8 nozzles in each nozzle group A) eject predetermined dots to form lines. Thus, because in which of the regions partitioned by the partition patterns 74 there are defective nozzles can be grasped, it becomes easy to identify in which groups of the nozzle groups A forming the first drive pattern 70 there are defective nozzles.

Moreover, by using the first drive pattern 70 to identify the nozzle numbers of defective nozzles as described above rather than seeing simply whether or not there are defective nozzles, in which of the nozzle groups A there are defective nozzles can be grasped.

As described above, in the present exemplary embodiment, the partition patterns 74 are formed in the second drive pattern 72 each time nozzles corresponding to the number of nozzles in each of the nozzle groups A that form the first drive pattern 70 (in the present exemplary embodiment, 8 nozzles in each nozzle group A) eject predetermined dots to form lines. Thus, the first drive pattern 70 and the second drive pattern 72 can be alternately used to identify the nozzle numbers of defective nozzles.

Thus, in the second drive pattern 72, because in which of the regions partitioned by the partition patterns 74 there are defective nozzles can be grasped, the nozzle numbers of defective nozzles can be identified without having to identify in which step number of the diagonal lines 72A in the second drive pattern 72 there are defective nozzles. For this reason, it becomes easy to identify the nozzle numbers of defective nozzles. Further, because the number of dots that each nozzle ejects is small when the second drive pattern 72 is formed, it becomes possible to record, in a smaller area, a nozzle check pattern with which nozzle numbers can be identified.

Third Embodiment

Next, a third embodiment of the present invention will be described. The same reference numerals will be given to portions that are the same as those in the first embodiment, and description thereof will be omitted. Further, because the overall configuration of the inkjet recording apparatus in the present exemplary embodiment is the same as that in the first embodiment, description thereof will be omitted.

Figure 14A:
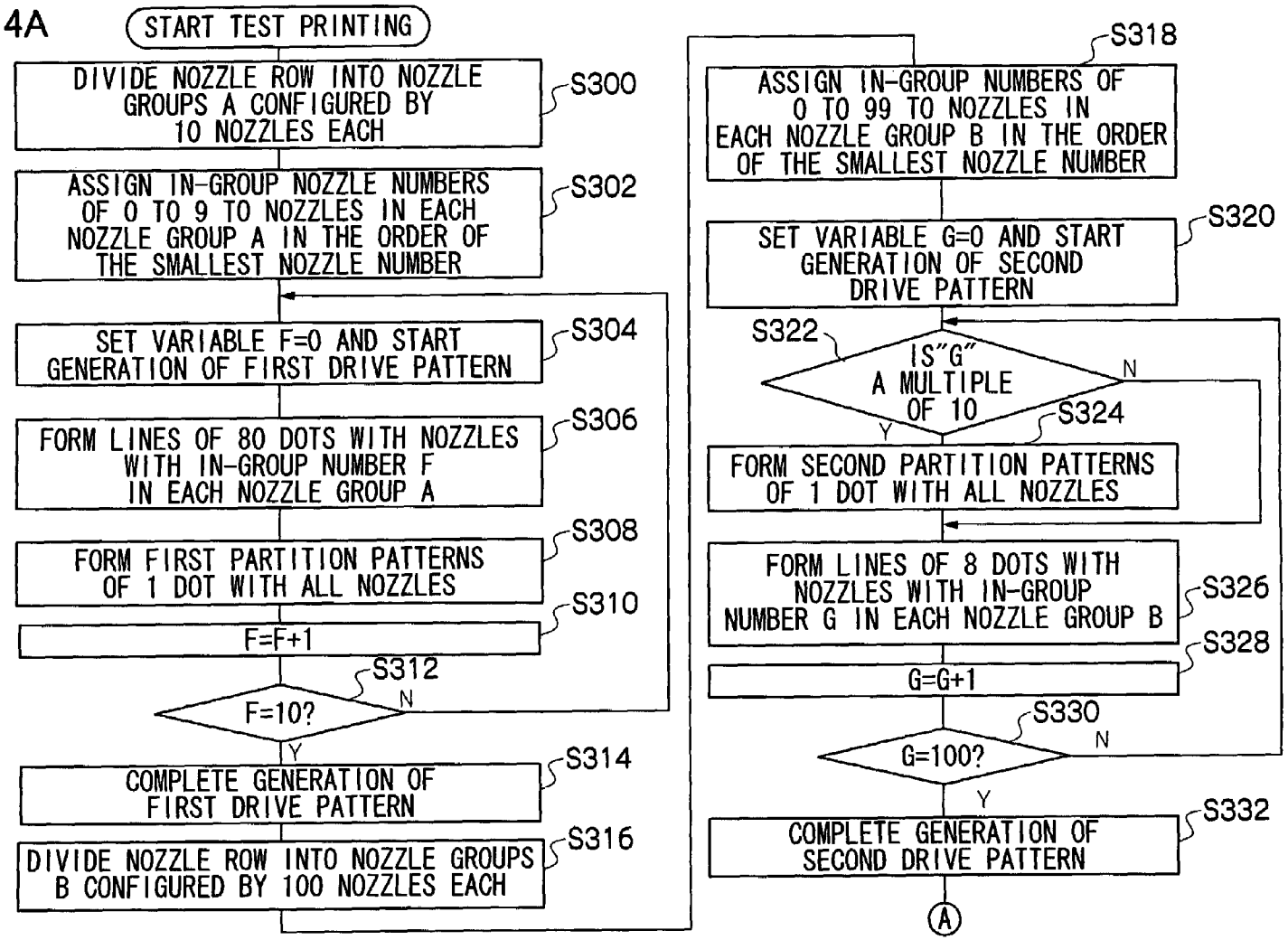
FIGS. 14A and 14B is a control flow diagram showing the sequence of recording a nozzle check pattern in an inkjet recording apparatus pertaining to a third embodiment of the invention.
Figure 14B:
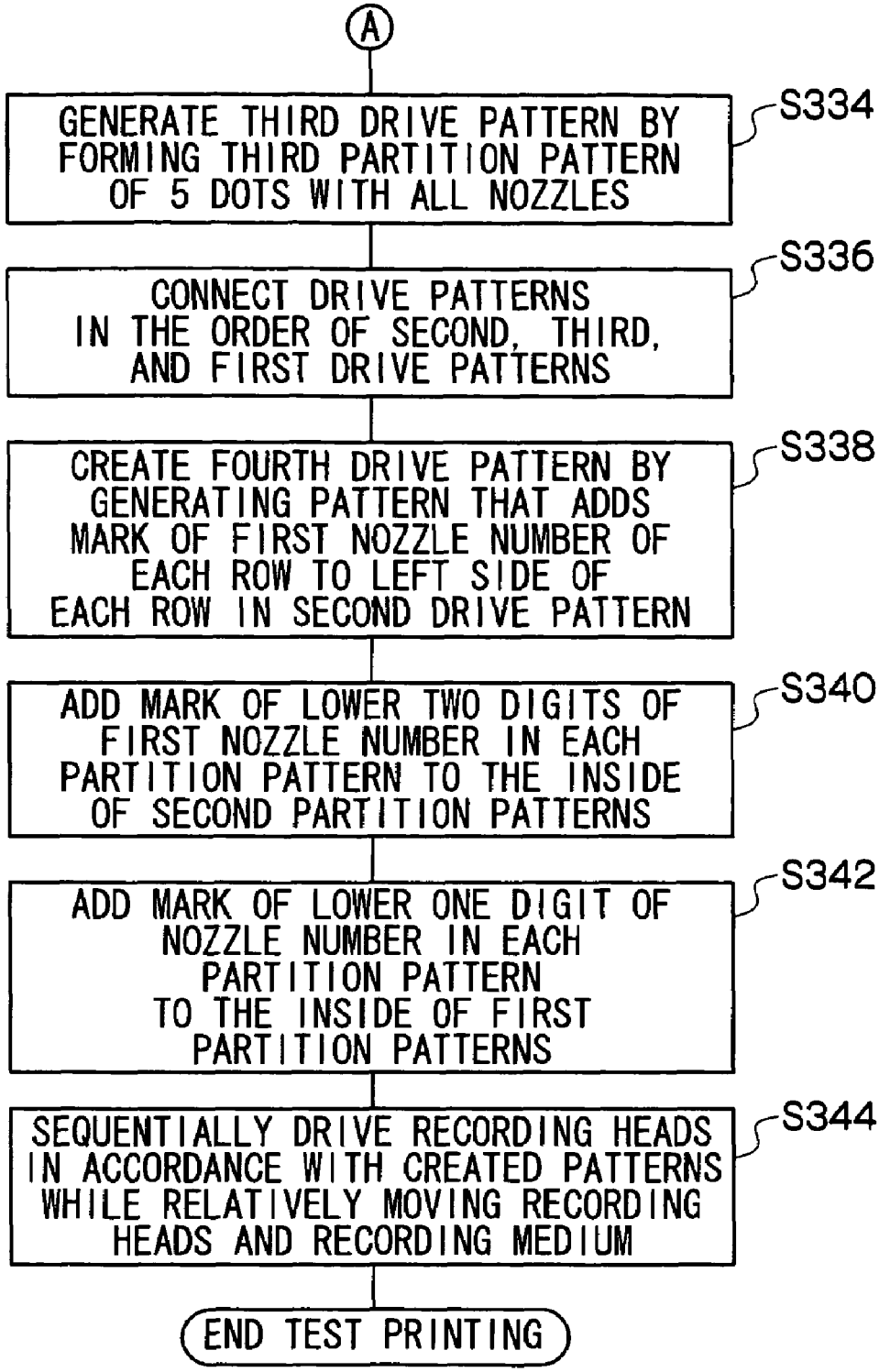

First, image recording of the nozzle check pattern in the inkjet recording apparatus pertaining to the present exemplary embodiment will be described on the basis of the control flow diagram shown in FIGS. 14A and 14B.

In the present exemplary embodiment, recording is conducted at 600×600 dpi by 600 npi inkjet recording heads where 6,880 nozzles are arranged.

When a command to start test printing is received, in step 300, the nozzle row is divided into plural nozzle groups A configured by 10 nozzles each.

In step 300, consecutive numbers (nozzle numbers 0 to 6,879) are assigned in order along the main scanning direction (direction orthogonal to the conveyance direction of the paper P) to the nozzles in the nozzle row, and the nozzle row is divided into groups comprising 10 nozzles each in the order of the smallest nozzle number. These nozzles groups become the nozzle groups A. Because there are 6,880 nozzles in the nozzle row pertaining to the present exemplary embodiment, the nozzle row is divided into 688 nozzle groups A. For example, one nozzle group A comprises nozzle numbers 0 to 9, another nozzle group A comprises nozzle numbers 10 to 19, and another nozzle group A comprises nozzle numbers 6,870 to 6,879.

These nozzle groups A correspond to the second nozzle groups recited in claim 1, and later-described nozzle groups B correspond to the first nozzle groups recited in claim 1. Further, the number of nozzle groups A is greater than the number of nozzle groups B.

Next, in step 302, in-group numbers of 0 to 9 are assigned in the order of the smallest nozzle number to each of the nozzles in each of the nozzle groups A. In the nozzle group A configured by nozzles with the nozzle numbers of 0 to 9, in-group numbers of 0 to 9 are assigned in the order of the nozzle numbers 0 to 9. In the nozzle group A configured by nozzles with the nozzle numbers of 10 to 19, in-group numbers of 0 to 9 are assigned in the order of the nozzle numbers 10 to 19. And in the nozzle group A configured by nozzles with the nozzle numbers of 6,870 to 6,879, in-group numbers 0 to 9 are assigned in the order of the nozzle numbers 6,870 to 6,879. In-group numbers are assigned in the same manner to the nozzles of the other nozzle groups A.

Next, in step 304, a variable F=0 is set and the generation of the first drive pattern is started.

Next, in step 306, a line of 80 dots is formed by nozzles with in-group number F in each of the nozzle groups A. Lines of 80 dots are formed simultaneously in regard to nozzles whose in-group numbers are the same. In the inkjet recording head of the present exemplary embodiment, the lines of 80 dots are about 3.4 mm.

Next, in step 308, first partition patterns 83 (corresponding to the second partition lines recited in claim 9) of 1 dot are formed by all of the 6,880 nozzles.

Next, in step 310, 1 is added to the variable F, and in step 312, it is determined whether the variable F is 10. When the variable F is not 10, the control flow returns to step 304 and steps 304 to 310 are repeated. When it is determined that the variable F is 10, in step 314, the generation of a first drive pattern 80 is completed.

Thus, in each of the nozzle groups A, a line of 80 dots each is formed in steps in order from the nozzle with the smallest nozzle number to the nozzle with the largest nozzle number. Thus, 688 diagonal lines 80A formed in steps (the number of steps is 10) are formed, and these become the first drive pattern 80 (see FIG. 15).

This first drive pattern 80 corresponds to the second pattern recited in claim 1, and a later-described second drive pattern 82 corresponds to the first pattern recited in claim 1.

Next, in step 316, the nozzle row is divided into plural nozzle groups B configured by 100 nozzles each. In step 316, the nozzles are divided into groups comprising 100 nozzles each in the order of the smallest nozzle number on the basis of the consecutive numbers assigned to the nozzle row in step 300. These nozzle groups become the nozzle groups B. Because there are 6,880 nozzles in the nozzle row pertaining to the present exemplary embodiment, the nozzle row is divided into 69 nozzle groups B. For example, one nozzle group B comprises nozzle numbers 0 to 99, another nozzle group B comprises nozzle numbers 100 to 199, another nozzle group B comprises nozzle numbers 6,700 to 6,799, and another nozzle group B comprises nozzle numbers 6,800 to 6,879. The nozzle group B comprising nozzle numbers 6,800 to 6,879 is configured by 80 nozzles that are an odd lot.

Next, in step 318, in-group numbers of 0 to 99 are assigned in the order of the smallest nozzle number to each of the nozzles in each of the nozzle groups B. In the nozzle group B configured by nozzles with the nozzle numbers of 0 to 99, in-group numbers of 0 to 99 are assigned in the order of the nozzle numbers 0 to 99. In the nozzle group B configured by nozzles with the nozzle numbers of 100 to 199, in-group numbers of 0 to 99 are assigned in the order of the nozzle numbers 100 to 199. And in the nozzle group B configured by nozzles with the nozzle numbers of 6,800 to 6,879, in-group numbers 0 to 79 are assigned in the order of the nozzle numbers 6,800 to 6,879. In-group numbers are assigned in the same manner to the nozzles of the other nozzle groups B.

Next, in step 320, a variable G=0 is set and the generation of the second drive pattern is started.

Next, in step 322, it is determined whether the variable G is a multiple of 10. When the variable G is not a multiple of 10, then the control flow moves to step 326. When the variable G is a multiple of 10, then second partition patterns 84 (corresponding to the first partition lines recited in claim 6) of 1 dot are formed by all of the 6,880 nozzles in step 324.

Next, in step 326, a line of 8 dots each is formed by the nozzles with the in-group number G in each of the nozzle groups B. The lines of 8 dots are about 0.34 mm in the inkjet recording head of the present exemplary embodiment. Lines of 8 dots each are formed simultaneously in regard to nozzles whose in-group numbers are the same.

Next, in step 328, 1 is added to the variable G, and in step 330, it is determined whether the variable G is 100. When the variable G is not 100, then the control flow returns to step 322 and steps 322 to 328 are repeated. When it is determined that the variable G is 100, then the generation of the second drive pattern 82 is completed in step 332.

Thus, in each of the nozzle groups B, a line of 8 dots each is formed in steps in order from the nozzle with the smallest nozzle number to the nozzle with the largest nozzle number. Thus, 69 diagonal lines 82A formed in steps (the number of steps is 100, with the last row having 80 steps) are formed, and these become the second drive pattern 82 (see FIG. 15).

Next, in step 334, a partition pattern of 5 dots is formed by all of the 6,880 nozzles, whereby a third drive pattern (corresponding to the pattern partition line recited in claim 5) 88 is formed.

Next, in step 336, the drive patterns are connected along the sub-scanning direction in the order of the second drive pattern 82, the third drive pattern 88 and the first drive pattern 80.

Next, in step 338, a pattern is generated which adds the nozzle number of the first nozzle forming the first line (step) in each row (each diagonal line 82A) in the second drive pattern 82 (that is, the mark of the nozzle number that is the smallest in each of the nozzle groups B), and this pattern becomes a fourth drive pattern 85. These marks correspond to the "row number in second drive pattern×m×n" of the calculation conducted in the second embodiment.

Figure 15:
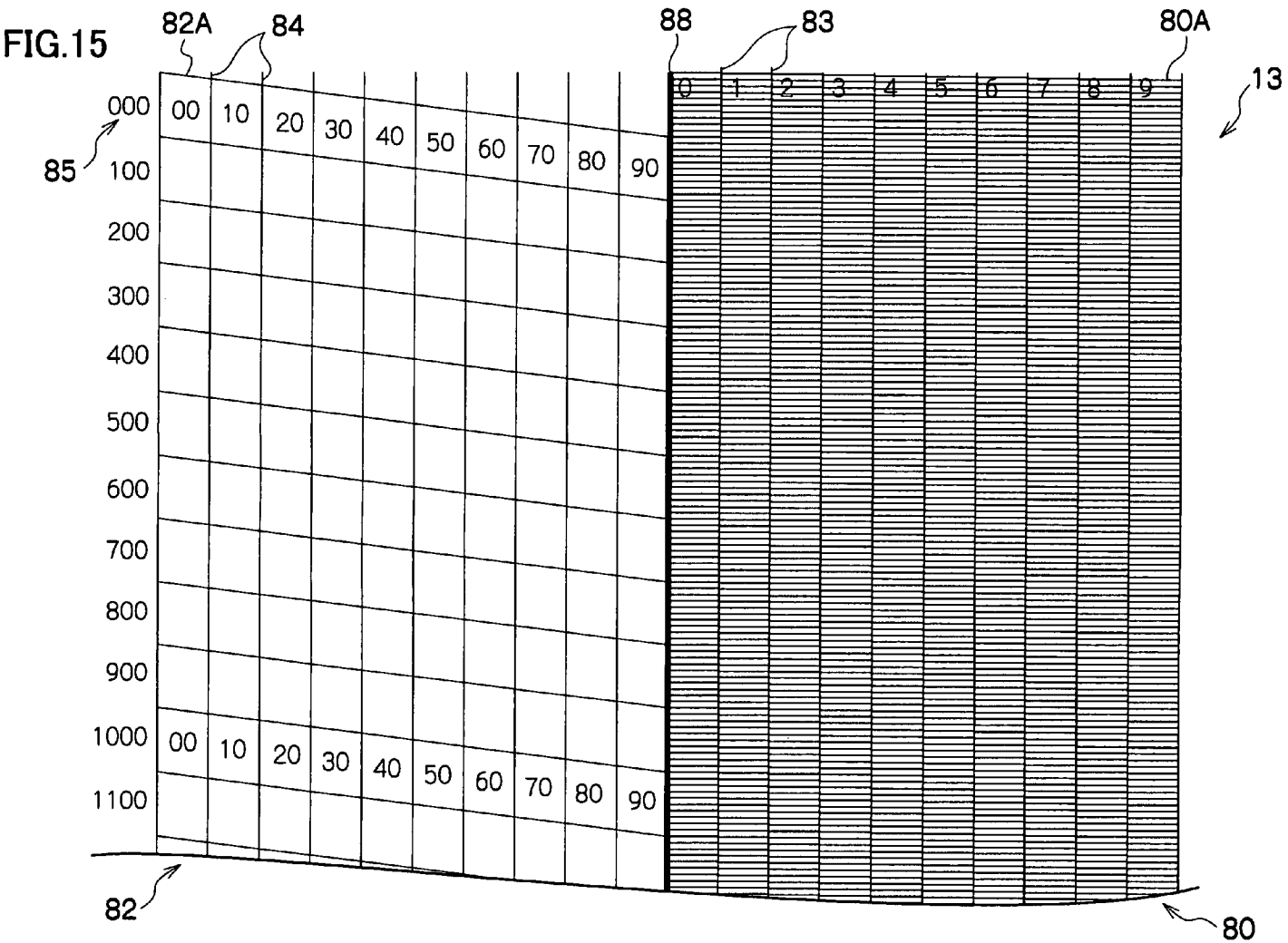
FIG. 15 is a diagram showing the nozzle check pattern pertaining to the third embodiment of the invention.

As shown in FIG. 15, in the present exemplary embodiment, these marks are added along the main scanning direction to positions at the end portion (left side in FIG. 15) of the diagonal lines 82A in the second drive pattern 82. The number "000" is added to the end portion of the first diagonal line 82A, and the number "100" is added to the end portion of the second diagonal line 82A. Further, the marks are added to positions that are between the first nozzle and the last nozzle of each of the diagonal lines 82A (in the first line, between the nozzle with nozzle number 0 and the nozzle with nozzle number 99) and which do not overlap the second drive pattern 82.

Figure 16:
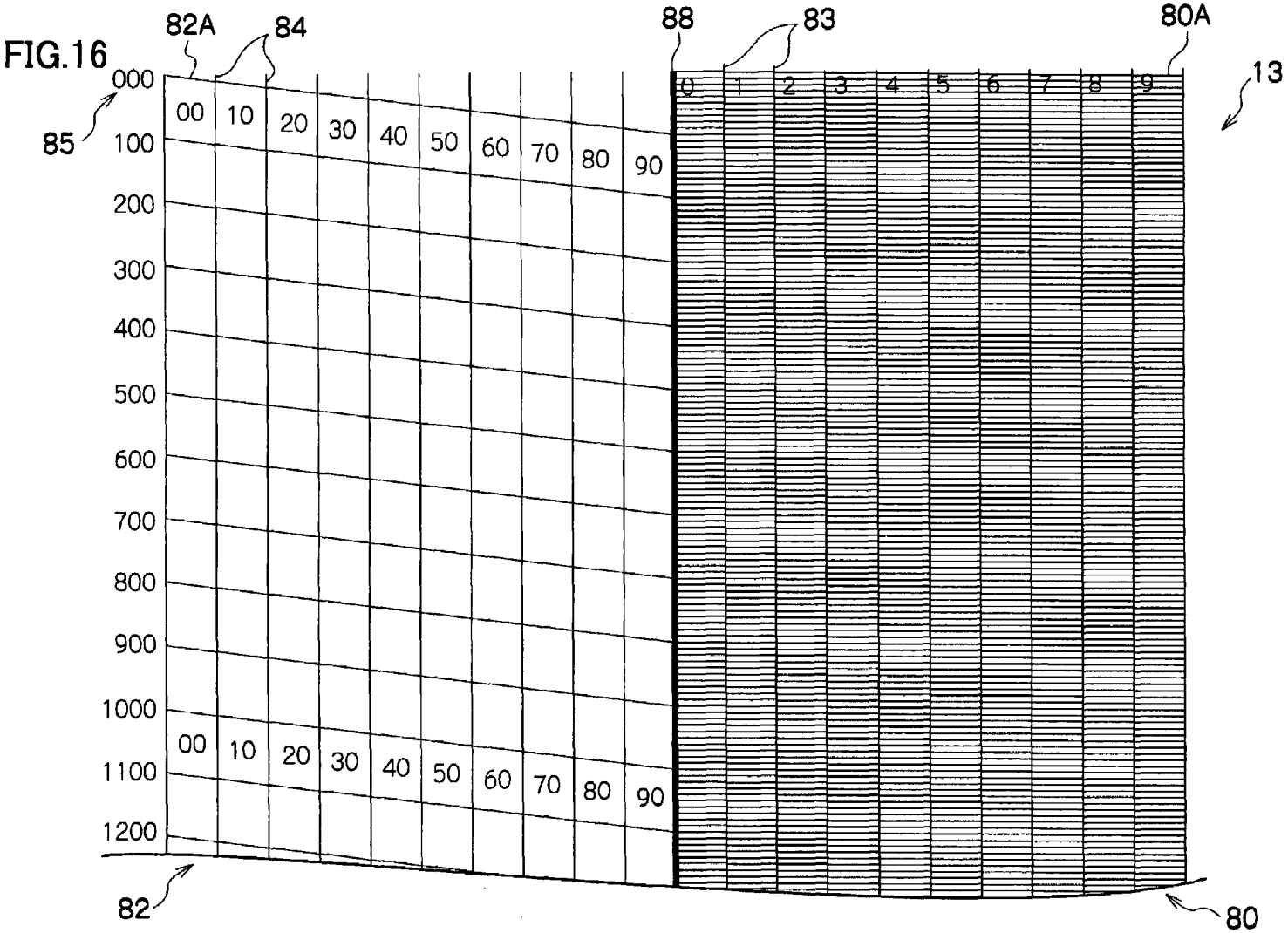
FIG. 16 is a diagram showing a modification of the nozzle check pattern pertaining to the third embodiment of the invention.

As shown in FIG. 16, the marks may also be disposed such that the centers of the marks correspond to the first position of each line. It suffices for the reference numerals to be added to the vicinities of the start of each row in the second drive pattern 82, such as positions at the end portion of the second drive pattern 82 in the sub-scanning direction.

Next, in step 340, a mark of the lower two digits of the nozzle number of the first nozzle forming the first line (step) in each partition pattern 84 is added inside each partition pattern 84 (regions partitioned by the second partition patterns 84). These marks correspond to the "column number in second drive pattern×m" of the calculation conducted in the second embodiment.

For example, in the section where there is the mark "10", the nozzles forming the first diagonal line 82A from the top are nozzle numbers 10 to 19. In the case of the second diagonal line 82A, the nozzles are the nozzle numbers 110 to 119, and in the case of the third diagonal line 82A, the nozzles are the nozzle numbers 210 to 219. That is, the lower two digits of the nozzle numbers of the first nozzles forming the diagonal lines 82A between the second partition patterns 84 are always constant.

In the present exemplary embodiment, the marks are added in the measure of pairs to 10 rows. The marks may also be added to every row, but it is not preferable to add them to every row from the standpoint of visibility. Further, the marks are added at positions where they do not overlap the second drive pattern 82. This is because defects in the lines become unrecognizable.

Next, in step 342, a mark of the lower one digit of the nozzle number of the nozzle forming the line inside each partition pattern is added inside the first partition patterns 83. These marks correspond to the "column number in first drive pattern" of the calculation conducted in the second embodiment.

For example, in the section where there is the reference numeral "0", the nozzle forming the first diagonal line 80A from the top is nozzle number 0. In the case of the second diagonal line 80A, the nozzle is nozzle number 10, and in the case of the third diagonal line 80A, the nozzle is nozzle number 20. That is, the lower one digits of the nozzle numbers of the nozzles forming the diagonal lines 80A in the first partition patterns 83 are always constant.

It is preferable to add these marks in a range that is easy to view, such as adding them in the measure of pairs to 100 lines. In FIG. 15, the marks overlap the first drive pattern 80, but both defects in the lines and the marks can be seen well if the marks do not overlap all of the lines configuring one step of the diagonal lines 80A.

Figure 17:
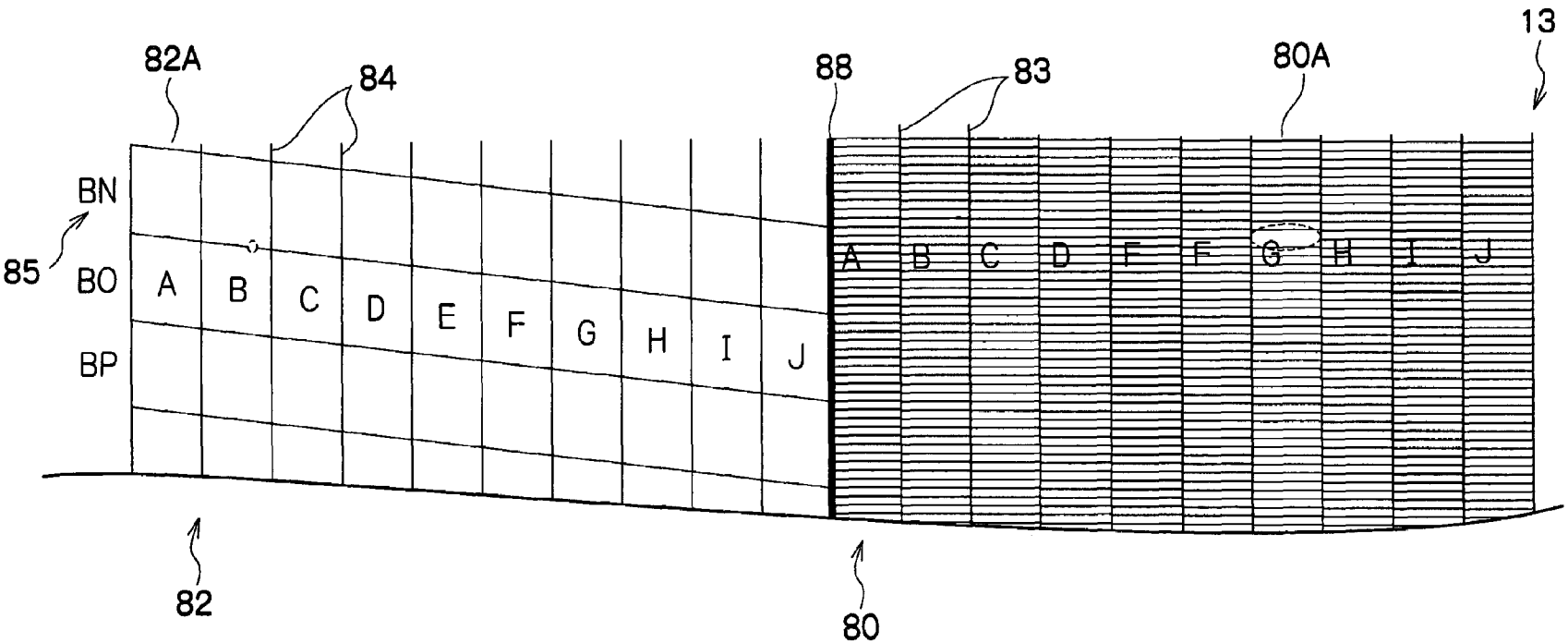
FIG. 17 is a diagram showing another modification of the nozzle check pattern pertaining to the third embodiment of the invention.

It will be noted that, as shown in FIG. 17, the marks added in steps 338 to 342 are not limited to numbers and may also be alphabetical letters, for example. The marks 000 to 6800 resulting from step 338 can be replaced with AA, AB, etc., to CQ, for example. The marks 00 to 90 resulting from step 340 can be replaced with A, B, etc., to J, for example. And the marks 0 to 9 resulting from step 342 can be replaced with A, B, etc., to J, for example. If the nozzle number is a later-described nozzle number 4,016, then it can be identified as BOBG.

Next, in step 344, the inkjet recording heads are sequentially driven in the order of the second drive pattern 82, the third drive pattern 88 and the first drive pattern 80 while the inkjet recording heads (recording heads) and the paper (recording medium) are relatively moved. The second drive pattern 82, the third drive pattern 88 and the first drive pattern 80 are generated by the controller 40. On the basis of the generated second drive pattern 82, third drive pattern 88 and first drive pattern 80, the controller 40 controls the driving of the inkjet recording heads 32 and, as shown in FIG. 15, records a nozzle check pattern 13 configured by the second drive pattern 82, the third drive pattern 88 and the first drive pattern 80 on the same paper P by the same recording scanning, and the test printing ends.

Figure 18:
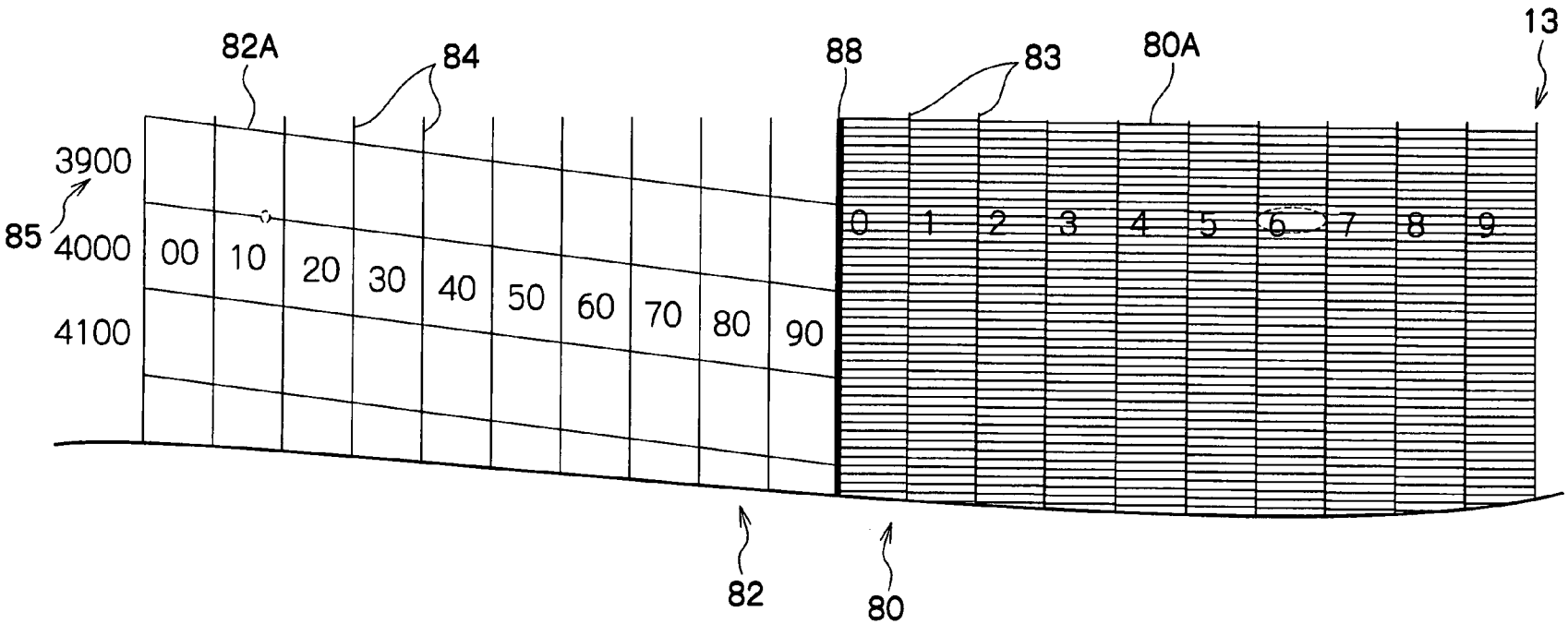
FIG. 18 is a diagram showing a case where a defective nozzle is present in the nozzle check pattern pertaining to the third embodiment of the invention.

Next, the method of identifying the nozzle numbers of defective nozzles when defective nozzles are present in the inkjet recording heads pertaining to the present exemplary embodiment will be described. FIG. 18 shows an example where nozzle number 4,016 has become unable to eject liquid droplets.

In a case where the identification of the nozzle number is conducted in the same manner as in the second embodiment by the calculation of nozzle number=(row number in second drive pattern×m×n)+(column number in second drive pattern×m)+(column number in first drive pattern), when counted in the same manner as in the second embodiment, it is the $40^{th}$ row in the second drive pattern, the $1^{st}$ column in the second drive pattern, and the $6^{th}$ column in the first drive pattern. Thus, because m=n=10, the nozzle number can be identified as being nozzle number 4,016 (=40×10×10+1×10+6).

However, because marks are added in the present exemplary embodiment, the nozzle number (4000+10+6=4,106) can be immediately determined from the mark of the defective position.

In this case, because m=n=10, it is extremely easy to calculate digits in decimal calculation. Further, by using just the lower fourth digit and third digit for the mark in step 338 and using just the lower second digit for the mark in step 340, the nozzle number can be identified simply by putting together these numbers (e.g., the nozzle of number 4,016 can be identified by putting together 40 and 1 and 6).

As described above, according to the present exemplary embodiment, the nozzle check pattern is divided into the first drive pattern 80 and the second drive pattern 82, and the numbers of their respective groups are different. Thus, a pattern (first drive pattern 80) whose intervals are narrow in the main scanning direction and with which defective nozzles can be grasped at a glance and a pattern (second drive pattern 82) whose intervals are wide in the main scanning direction and with which it is easy to grasp the positions of defective nozzles can be recorded.

Thus, visual recognition becomes easy because nozzle numbers where nozzle clogging and ejection direction defects have occurred are indicated by the first drive pattern 80 and the nozzle numbers can be identified with the second drive pattern 82.

Further, by repeating the work of recognizing the number of defective nozzles with the pattern (first drive pattern 80) with which the number of defective nozzles is easy to grasp, moving one's line of sight in the sub-scanning direction (direction orthogonal to the main scanning direction) with respect to defective nozzles that have been recognized, and identifying nozzle numbers with the pattern (second drive pattern 82) with which defective nozzle numbers can be identified, it becomes possible to identify defective nozzle numbers while reducing the potential for defective nozzles to be overlooked.

Further, in the present exemplary embodiment, the first drive pattern 80 is used to identify the nozzle numbers of defective nozzles as described above rather than seeing simply whether or not there are defective nozzles. Thus, because where in the regions partitioned by the partition patterns 84 there are defective nozzles can be grasped in the second drive pattern 82, it becomes unnecessary to identify in which step number of the diagonal lines 82A of the second drive pattern 82 there are defective nozzles. For this reason, it becomes easy to identify the nozzle numbers of defective nozzles. Further, because the number of dots that each nozzle ejects is small when the second drive pattern 82 is formed, it becomes possible to record, in a smaller area, a nozzle check pattern with which nozzle numbers can be identified.

Further, defective nozzles can be easily identified without having to count the row numbers or step numbers of the lines that are formed and without having to calculate based on the counted number.

In the third embodiment, m and n in the second embodiment are such that m=n=10, and the notation of the nozzle numbers is expressed as an m base (or n base), that is, decimally. Thus, because the number of a defect (pattern defect) position on the first drive pattern 80 and the second drive pattern 82 matches the number of each digit when the number of a defective nozzle is expressed as an m base (or n base), needless conversion such as calculating digits becomes unnecessary, and the defective nozzle can be identified more easily.

It will be noted that it is not necessary for m and n to be 10. For example, in a 1200 npi recording head, the test pattern becomes tighter. In this case, 16 can be used for m and n of the second embodiment, and the notation of the nozzle numbers can be hexadecimal. In this case, Y and Z of the second embodiment (number of dots in the line that each nozzle forms) can be appropriately set to ensure regions where visible marks can be added. Further, by changing the fatness of the partition patterns every fixed number, the patterns become easier to see.

In the above-described first to third embodiments, sequences of generating nozzle check patterns are described, but it is not invariably necessary for a nozzle check pattern to be generated each time a nozzle check pattern is to be recorded. For example, the same effects can also be obtained by storing a pattern equivalent to the above in the non-volatile memory 48 (see FIG. 5), reading the image data stored in the non-volatile memory 48 when a nozzle check pattern is to be recorded, and recording the pattern in accordance with that information.

Further, in the above-described first to third embodiments, an inkjet recording apparatus that ejects ink to record an image is described as the liquid droplet ejection apparatus that ejects liquid droplets, and inkjet recording heads that eject ink to record an image are described as the liquid droplet ejection heads that eject liquid droplets. However, the liquid droplet ejection apparatus pertaining to an aspect of the present invention is not limited to an apparatus that records images on recording paper, and the liquid that is ejected is not limited to ink.

For example, the present invention can be applied to all industrially used liquid droplet ejection apparatus and to liquid droplet ejection heads used in those liquid droplet ejection apparatus, such as apparatus that create display-use color filters by ejecting colored ink onto polymer film and glass and apparatus that form bumps for mounting parts by ejecting molten solder onto a substrate. The present invention is not limited to the above-described embodiments; various modifications, changes and improvements are possible as long as they do not depart from the spirit of the present invention.

According to the configuration of an aspect of the present invention, the first pattern is formed by ejecting predetermined dots of liquid droplets onto the recording medium from the nozzle with the smallest number in each of the first nozzle groups configured by dividing the nozzle row and ejecting liquid droplets to the nozzle with the largest number.

Thus, lines of a predetermined length extending along the moving direction in which the recording medium relatively moves and corresponding to the number of nozzles are formed in the direction orthogonal to the moving direction, and step-like diagonal lines are formed. The step-like diagonal lines are formed in a number corresponding to the number of the first nozzle groups at intervals corresponding to the number of nozzles configuring the first nozzle groups.

Here, where there is a clogged nozzle, part of the step-like diagonal lines is deficient, and the clogged nozzle can be identified by counting the nozzle number of the deficient portion. Further, if there is a nozzle with a defect in the ejection direction in which the nozzle ejects liquid droplets, the diagonal lines become an irregular step-like shape, so the nozzle with the defective ejection direction can be identified by counting the nozzle number of the irregular portion.

However, when the number of nozzles is large, the step-like diagonal lines become narrow, so it becomes difficult to visually identify deficient portions and whether or not there are irregularly ejected portions.

Thus, in an aspect of the present invention, the second nozzle pattern is formed by the second nozzle groups whose number is larger than that of the first nozzle groups. Similar to the first pattern, the second pattern is formed by ejecting predetermined dots of liquid droplets onto the conveyed recording medium from the nozzle with the smallest number in each of the second nozzle groups configured by dividing the nozzle row and ejecting liquid droplets to the nozzle with the largest number.

Thus, lines of a predetermined length extending along the moving direction in which the recording medium relatively moves and corresponding to the number of nozzles are formed in the direction orthogonal to the moving direction, and step-like diagonal lines are formed. The step-like diagonal lines are formed in a number corresponding to the number of the second nozzle groups at intervals corresponding to the number of nozzles configuring the second nozzle groups.

Because the number of the second nozzle groups is larger than the number of the first nozzle groups, the number of nozzles in the groups configuring the second nozzle groups is fewer, and intervals of the step-like diagonal lines are formed close together in the second pattern configured by the second nozzle groups. For this reason, the second pattern has a predetermined density, places where nozzle clogging and ejection direction defects have occurred can be discriminated as white spots, and the presence of defective nozzles can be visually recognized.

Thus, visual confirmation becomes easy because nozzle numbers where nozzle clogging and ejection direction defects have occurred are indicated by the second pattern and the nozzle numbers can be identified with the first pattern. Consequently, according to the first aspect of the invention, whether or not there are nozzles with ejection defects including ejection direction defects can be easily recognized, and those nozzles can be identified easily.

Further, in the nozzle check pattern of an aspect of the present invention, in the above-described configuration, the first nozzle groups may be configured by a number of nozzles that is a multiple of the number of nozzles configuring the second nozzle groups.

Further, in the nozzle check pattern of an aspect of the present invention, in the above-described configuration, the first nozzle groups may be configured by a number of nozzles obtained by squaring the number of nozzles configuring the second nozzle groups.

Further, in the nozzle check pattern of an aspect of the present invention, in the above-described configuration, the first nozzle groups may be configured by 100 nozzles each and the second nozzle groups may be configured by 10 nozzles each.

Further, in the nozzle check pattern of an aspect of the present invention, in the above-described configuration, a pattern partition line may be formed which partitions the first pattern and the second pattern in a direction orthogonal to the moving direction of the recording medium.

Further, in the nozzle check pattern of an aspect of the present invention, in the above-described configuration, first partition lines may be formed which partition the first pattern at predetermined intervals in a direction orthogonal to the moving direction of the recording medium.

Further, in the nozzle check pattern of an aspect of the present invention, in the above-described configuration, the first partition lines may be formed each time nozzles corresponding to the number of nozzles configuring the second nozzle groups eject the predetermined dots.

Further, in the nozzle check pattern of an aspect of the present invention, in the above-described configuration, the first partition lines may be formed each time 10 nozzles eject the predetermined dots.

Further, in the nozzle check pattern of an aspect of the present invention, in the above-described configuration, second partition lines may be formed which partition the second pattern at predetermined intervals in a direction orthogonal to the moving direction of the recording medium.

Further, in the nozzle check pattern of an aspect of the present invention, in the above-described configuration, the second partition lines may be formed each time 1 nozzle ejects the predetermined dots.

Further, in the nozzle check pattern of an aspect of the present invention, in the above-described configuration, nozzle numbers with the smallest number in each of the first nozzle groups may be recorded along a direction orthogonal to the moving direction of the recording medium.

Further, in the nozzle check pattern of an aspect of the present invention, in the above-described configuration, the number of the predetermined dots ejected in the first pattern may be smaller than the number of the predetermined dots ejected in the second pattern.

Further, a liquid droplet ejection apparatus of an aspect of the present invention can eject liquid droplets to form the nozzle check pattern.

What is claimed is:

1. A method of forming a nozzle check pattern by relatively moving a recording medium with respect to a liquid droplet ejection head in which a nozzle row is formed and ejecting liquid droplets from the nozzle row onto the recording medium, the method comprising:

forming a first pattern by assigning consecutive numbers in order to the nozzles in the nozzle row, dividing the nozzle row into a plurality of first nozzle groups, and ejecting predetermined dots onto the recording medium in order from the nozzle with the smallest number to the nozzle with the largest number in each of the first nozzle groups; and forming a second pattern by dividing the nozzle row into plural second nozzle groups whose number is larger than that of the first nozzle groups and ejecting predetermined dots onto the recording medium in order from the nozzle with the smallest number to the nozzle with the largest number in each of the second nozzle groups.

2. The method of claim 1, wherein the first nozzle groups are configured by a number of nozzles that is a multiple of the number of nozzles configuring the second nozzle groups.

3. The method of claim 2, wherein the first nozzle groups are configured by a number of nozzles obtained by squaring the number of nozzles configuring the second nozzle groups.

4. The method of claim 3, wherein the first nozzle groups are configured by 100 nozzles each and the second nozzle groups are configured by 10 nozzles each.

5. The nozzle check pattern of claim 1, wherein a pattern partition line is formed which partitions the first pattern and the second pattern in a direction orthogonal to the moving direction of the recording medium relative to the liquid droplet ejection head.

6. The nozzle check pattern of claim 1, wherein first partition lines are formed which partition the first pattern at predetermined intervals in a direction orthogonal to the moving direction of the recording medium relative to the liquid droplet ejection head.

7. The nozzle check pattern of claim 6, wherein the first partition lines are formed each time nozzles corresponding to the number of nozzles configuring the second nozzle groups eject the predetermined dots.

8. The nozzle check pattern of claim 7, wherein the first partition lines are formed each time 10 nozzles eject the predetermined dots.

9. The nozzle check pattern of claim 1, wherein second partition lines are formed which partition the second pattern at predetermined intervals in a direction orthogonal to the moving direction of the recording medium relative to the liquid droplet ejection head.

10. The nozzle check pattern of claim 9, wherein the second partition lines are formed each time 1 nozzle ejects the predetermined dots.

11. The nozzle check pattern of claim 1, wherein nozzle numbers with the smallest number in each of the first nozzle groups are recorded along a direction orthogonal to the moving direction of the recording medium relative to the liquid droplet ejection head.

12. The method of claim 1, wherein the number of the predetermined dots ejected in the first pattern is smaller than the number of the predetermined dots ejected in the second pattern.

13. The nozzle check pattern of claim 6, wherein marks corresponding to the nozzle number of the first nozzle forming the first line in each region are added to each region partitioned by the first partition lines.

14. The nozzle check pattern of claim 9, wherein marks corresponding to the nozzle number of the nozzle forming the line in each region are added to each region partitioned by the second partition lines.

15. The nozzle check pattern of claim 4, wherein first partition lines are formed which partition the first pattern at predetermined intervals in a direction orthogonal to the moving direction of the recording medium relative to the liquid droplet ejection head, second partition lines are formed which partition the second pattern at predetermined intervals in the direction orthogonal to the moving direction of the recording medium relative to the liquid droplet ejection head, marks corresponding to the lower two digits of the nozzle numbers of the first nozzles forming the first line in each region are added to each region partitioned by the first partition lines, and marks corresponding to the lower one digit of the nozzle numbers of the nozzles forming the lines in each region are added to each region partitioned by the second partition lines.

16. A liquid droplet ejection apparatus that ejects liquid droplets to form a nozzle check pattern, the liquid droplet ejection apparatus comprising:

a liquid droplet ejection head in which a nozzle row is formed; and a controller that causes a recording medium to move relative to the liquid droplet ejection head and ejects liquid droplets from the nozzle row onto the recording medium to form the nozzle check pattern, wherein the controller assigns consecutive numbers in order to the nozzles in the nozzle row, divides the nozzle row into a plurality of first nozzle groups, and ejects predetermined dots onto the recording medium in order from the nozzle with the smallest number to the nozzle with the largest number in each of the first nozzle groups to from a first pattern, and divides the nozzle row into second nozzle groups whose number is larger than that of the first nozzle groups and ejects predetermined dots onto the recording medium in order from the nozzle with the smallest number to the nozzle with the largest number in each of the second nozzle groups to form a second pattern.

* * * * *